US006897716B2

(12) United States Patent
Miyazaki

(10) Patent No.: US 6,897,716 B2
(45) Date of Patent: May 24, 2005

(54) VOLTAGE GENERATING APPARATUS INCLUDING RAPID AMPLIFIER AND SLOW AMPLIFIER

(75) Inventor: Kiyoshi Miyazaki, Kanagawa (JP)

(73) Assignee: NEC Electronics Corporation, Kawasaki (JP)

( * ) Notice: Subject to any disclaimer, the term of this patent is extended or adjusted under 35 U.S.C. 154(b) by 2 days.

(21) Appl. No.: 10/617,050

(22) Filed: Jul. 11, 2003

(65) Prior Publication Data

US 2004/0008197 A1 Jan. 15, 2004

(30) Foreign Application Priority Data

Jul. 12, 2002 (JP) ..... 2002-204130

(51) Int. Cl.[7] ..... G05F 1/10; G05F 3/02
(52) U.S. Cl. ..... 327/541; 345/212
(58) Field of Search ..... 327/530, 538, 327/540–541, 543; 345/210–212

(56) References Cited

U.S. PATENT DOCUMENTS 6,342,782 B1 * 1/2002 Yamaguchi et al. ..... 323/369
6,501,467 B2 * 12/2002 Miyazaki ..... 345/210

FOREIGN PATENT DOCUMENTS

| | | | |
|---|---|---|---|
| EP | 1070980 A1 * | 1/2001 | ..... G02F/1/133 |
| JP | 02150819 A * | 6/1990 | ..... G02F/1/133 |
| JP | 10-232383 | 9/1998 | |
| JP | 2000-020147 | 1/2000 | |

* cited by examiner

*Primary Examiner*—Quan Tra
(74) *Attorney, Agent, or Firm*—McGinn & Gibb, PLLC

(57) ABSTRACT

In a voltage generating apparatus, a slow or rapid discharging amplifier is connected between an input terminal and an output terminal, and a rapid or slow charging amplifier is connected between the input terminal and the output terminal. An offset voltage generating element is connected between the input terminal and one of the slow or rapid discharging amplifier and the rapid or slow charging amplifier, so that an input voltage applied to the slow or rapid discharging amplifier is higher than an input voltage applied to the rapid or slow charging amplifier.

24 Claims, 35 Drawing Sheets

*Fig. 3* PRIOR ART

| MODE | FRAM+ | | FRAM− | |
|---|---|---|---|---|
| | COM | SEG | COM | SEG |
| SELECTED | VLCD | GND | GND | VLCD |
| NON-SELECTED | VLC4 | VCL3 | VLC1 | VLC2 |

VMIN=VLC1−VLC2=VLC3−VLC4

VOLTAGE GENERATING APPARATUS INCLUDING RAPID AMPLIFIER AND SLOW AMPLIFIER

DESCRIPTION OF THE INVENTION

1. Field of the Invention

The present invention relates to a voltage generating apparatus for driving a capacitive load, and for example, to a gradation voltage generating apparatus used in an apparatus for driving a liquid crystal display (LCD) panel.

2. Description of the Related Art

Generally, an apparatus for driving an LCD panel is constructed by a gradation voltage generating circuit as a power supply voltage generating circuit for generating gradation voltages and decoders for selecting two of the gradation voltages and applying the two gradation voltages to the LCD panel.

In a first prior art LCD driving apparatus (see: FIG. 5 of JP-A-2000-20 147), a gradation voltage generating circuit is constructed by a series of resistors and voltage-follower-type amplifiers for performing impedance transformation upon voltages at nodes of the resistors, and capacitors each connected to one of the voltage-follower-type amplifiers. Each of the voltage-follower-type amplifiers is a slow discharging amplifier or a slow charging amplifier with a single end type output circuit. This will be explained later in detail.

In the above-described first prior art LCD driving apparatus, however, since the transient response is very low due to the single end type output circuit, the above-mentioned capacitors are externally provided to suppress the fluctuation of the transient response. This results in increasing the apparatus in size and cost.

In a second prior art LCD driving apparatus (see: FIG. 3 of JP-A-10-232383 and FIG. 7 of JP-A-2000-20147), a gradation voltage generating circuit is constructed by push-pull type amplifiers each including a slow discharging amplifier with a single end output circuit and a slow charging amplifier with a single end output circuit instead of the voltage-follower-type amplifiers of the first prior art LCD driving apparatus each with a single end output circuit. This also will be explained later in detail.

In the above-described second prior art LCD driving apparatus, however, since each of the discharging and charging amplifiers forming one push-pull type amplifier is of a slow type, the transient response is still low, which would invite flicker.

SUMMARY OF THE INVENTION

It is an object of the present invention to provide a voltage generating apparatus such as a gradation voltage generating circuit in an LCD driving apparatus having rapid transient response characteristics.

According to the present invention, in a voltage generating apparatus, a slow or rapid discharging amplifier is connected between an input terminal and an output terminal, and a rapid or slow charging amplifier is connected between the input terminal and the output terminal. An offset voltage generating element is connected between the input terminal and one of the slow or rapid discharging amplifier and the rapid or slow charging amplifier, so that an input voltage applied to the slow or rapid discharging amplifier is higher than an input voltage applied to the rapid or slow-charging amplifier. Thus, the transient response speed can be increased due to the presence of the rapid discharging amplifier or the rapid charging amplifier.

BRIEF DESCRIPTION OF THE DRAWINGS

The present invention will be more clearly understood from the description set forth below, as compared with the prior art, with reference to the accompanying drawings, wherein:

FIG. 3 is a table for showing examples of the voltages at the common electrode and the segment element of FIG. 1;

DESCRIPTION OF THE PREFERRED EMBODIMENTS

Before the description of the preferred embodiments, prior art LCD driving apparatuses will be explained with reference to FIGS. 1, 2A, 2B, 3, 4, 5, 6, 7, 8, 9, 10, 11, 12, 13 and 14.

Figure 1:
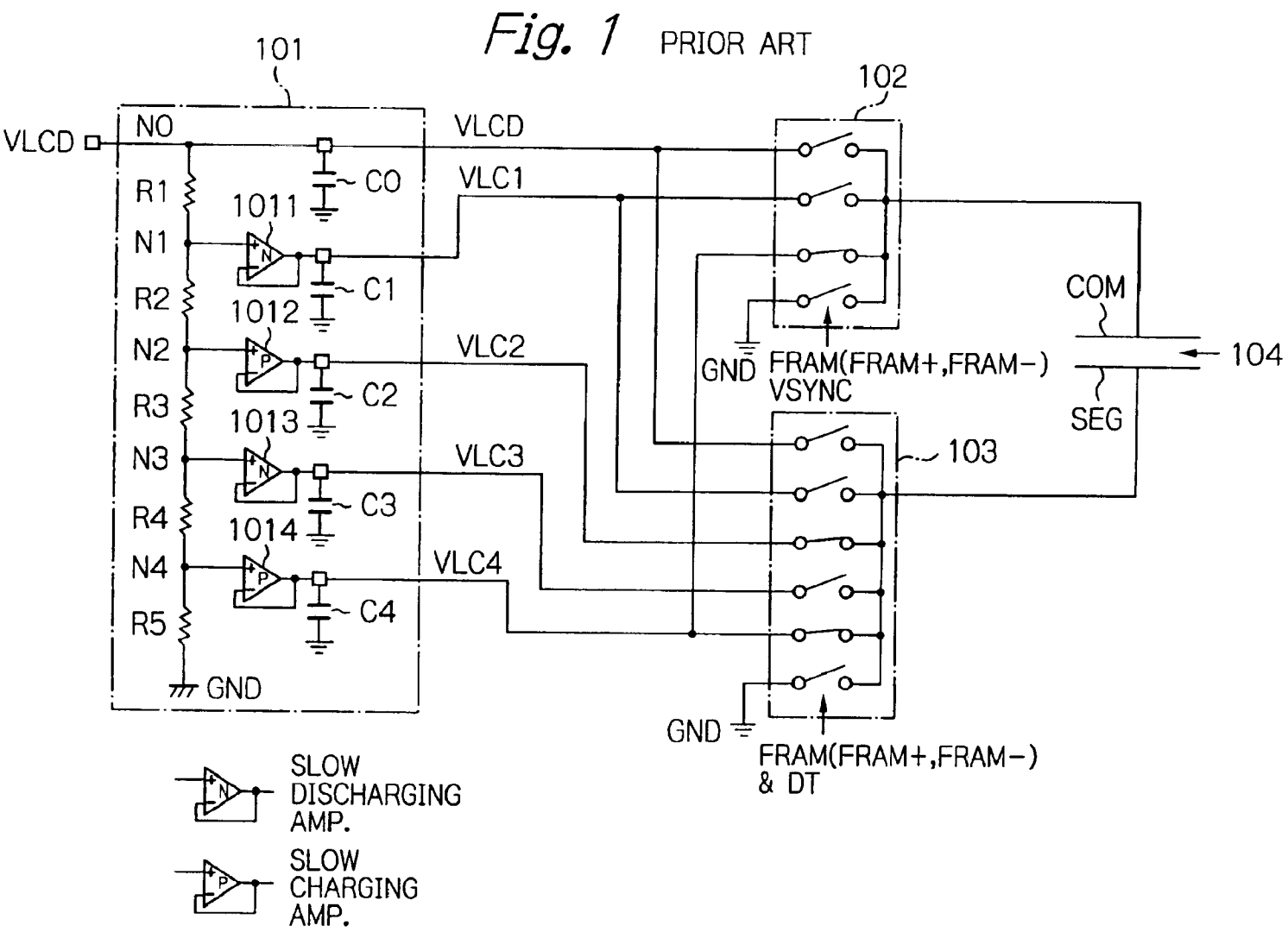
Fig. 1 PRIOR ART
FIG. 1 is a circuit diagram illustrating a first prior art LCD driving apparatus.
Figure 5:
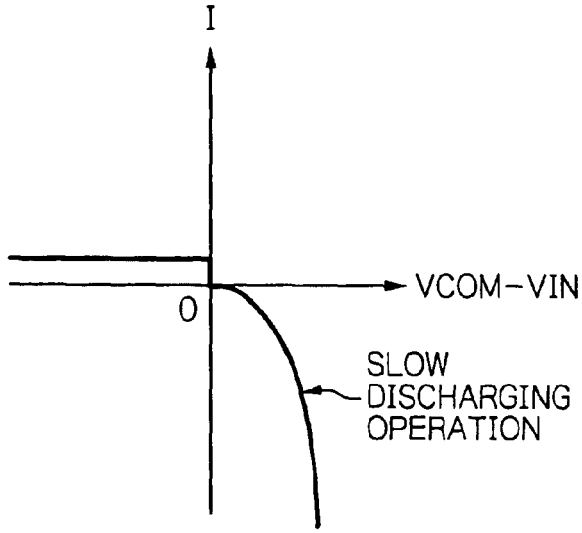
Fig. 5 PRIOR ART
FIG. 5 is a graph showing the voltage-to-current characteristics of the slow discharging amplifier of FIG. 4.

In FIG. 1, which illustrates a first prior art LCD driving apparatus (see: FIG. 5 of JP-A-2000-20147), a gradation voltage generating circuit 101 generates gradation voltages VLCD, VLC1, VLC2, VLC3, VLC4 and GND, and transmits the gradation voltages to decoders 102 and 103. Note that the gradation voltage VLCD is generally much higher than a power supply voltage $V_{DD}$. For example, the gradation voltage VLCD can be generated by using a DC/DC converter.

The decoder 102 selects one of the gradation voltages VLCD, VLC1, VLC4 and GND in accordance with a frame polarity signal FRAM having a positive polarity FRAM+ and a negative polarity FRAM− and a vertical synchronization signal VSYNC, so that the selected gradation voltage is applied to a common electrode COM of a liquid crystal panel 104.

On the other hand, the decoder 103 selects one of the gradation voltages VLCD, VLC1, VLC2, VLC3, VLC4 and GND in accordance with the frame signal FRAM and a corresponding gradation data DT, so that the selected gradation voltage is applied to a segment electrode SEG of the liquid crystal panel 104. Note that there are generally a plurality of segment electrodes in the liquid crystal panel 104; however, in order to simplify the description, only one segment is illustrated.

The gradation voltage generating circuit 101 is constructed by a series of resistors R1, R2, R3, R4 and R5 serving as a voltage divider for dividing a voltage between VLCD and GND, voltage-follower-type amplifiers 1011, 1012, 1013 and 1014 for impedance transformation connected to nodes N1, N2, N3 and N4, respectively, of the resistors R1, R2, R3, R4 and R5, and capacitors C1, C2, C3, C4 and C5.

Figure 2A:
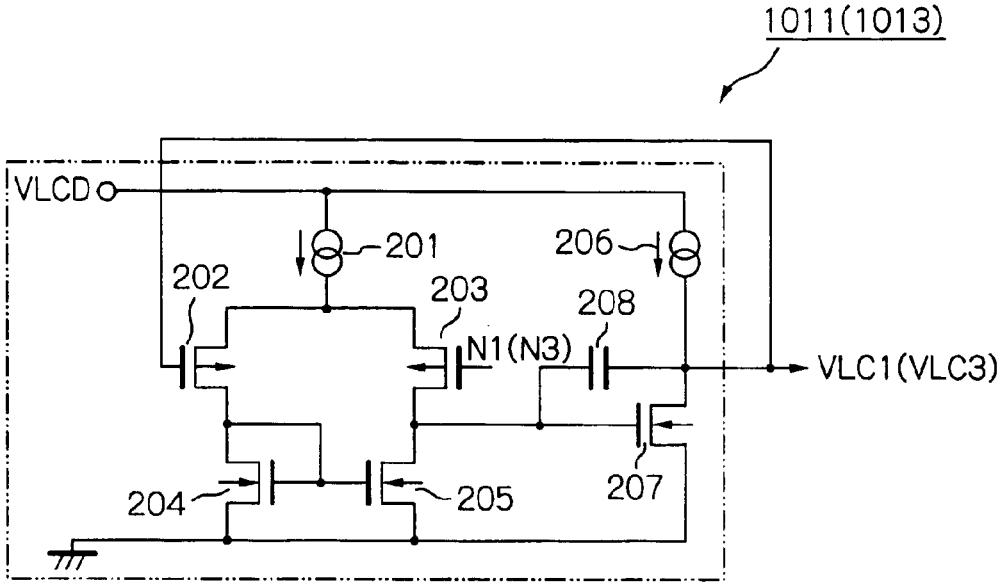
Fig. 2A PRIOR ART
FIG. 2A is a circuit diagram of the slow discharging amplifier as the voltage-follower-type amplifier of FIG. 1.
Figure 2B:
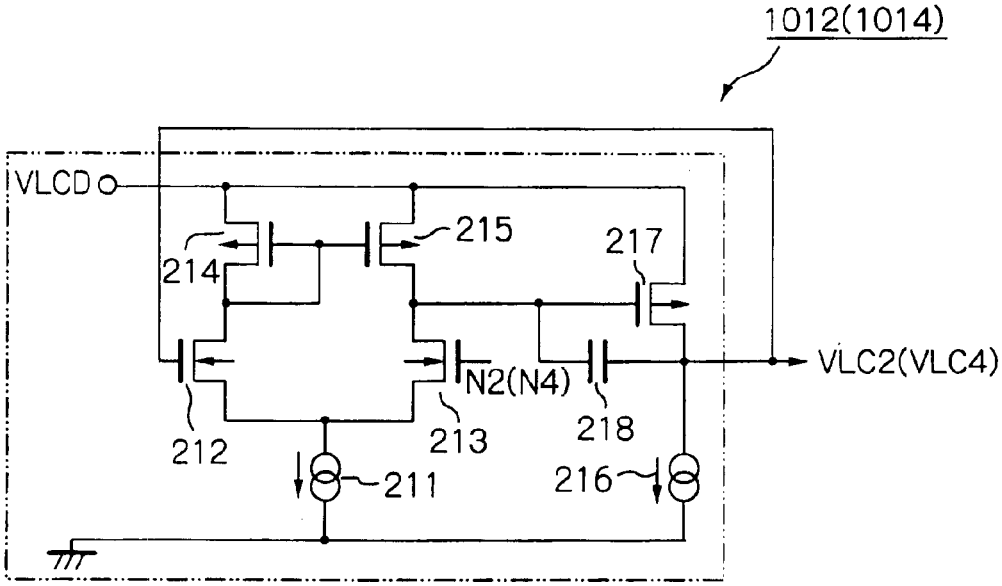
Fig. 2B PRIOR ART
FIG. 2B is a circuit diagram of the slow charging amplifier as the voltage-follower-type amplifier of FIG. 1.

Each of the voltage-follower-type amplifiers 1011, 1012, 1013 and 1014 is constructed by a slow discharging amplifier as illustrated in FIG. 2A or a slow charging amplifier as illustrated in FIG. 2B in accordance with the driving method for the liquid crystal panel 104. For example, each of the voltage-follower-type amplifiers 1011 and 1013 is constructed by the slow discharging amplifier as illustrated in FIG. 2A, and each of the voltage-follower-type amplifiers 1012 and 1014 is constructed by the slow charging amplifier as illustrated in FIG. 2B.

In more detail, as illustrated in FIG. 2A, the slow discharging amplifier is constructed by a differential amplifier formed by a current source 201, P-channel MOS transistors 202 and 203, N-channel MOS transistors 204 and 205, a single end output circuit formed by a current source 206 and an N-channel MOS transistor 207, and a capacitor 208. In this case, the voltage at the node N1(N3) is applied to the gate of the transistor 203. On the other hand, the voltage VLC1 (VLC3) is negatively fed back to the gate of the MOS transistor 202. Note that if the voltage VLC1 (VLC3) is fed back to the gate of the MOS transistor 202 without the capacitor 208, oscillation may occur. Since the capacitor 208 serves as a phase compensating element, the amplifier of FIG. 2A is of a slow type for avoiding the above-mentioned oscillation.

Similarly, as illustrated in FIG. 2B, the slow charging amplifier is constructed by a differential amplifier formed by a current source 211, N-channel MOS transistors 212 and 203, P-channel MOS transistors 214 and 215, a single end output circuit formed by a current source 216 and a P-channel MOS transistor 217, and a capacitor 218. In this case, the voltage at the node N2 (N4) is applied to the gate of the transistor 213. On the other hand, the voltage VLC2 (VLC4) is negatively fed back to the gate of the MOS transistor 212. Note that if the voltage VLC2 (VLC4) is fed back to the gate of the MOS transistor 202 without the capacitor 218, oscillation may occur. Since the capacitor 218 serves as a phase compensating element, the amplifier of FIG. 2B is of a slow type for avoiding the above-mentioned oscillation.

Each of the voltage-follower-type amplifiers 1011, 1012, 1013 and 1014 has a single-end type output circuit, not a push-pull type output circuit, so that no large penetration current flows therethrough, since a current flowing through the single-end type output circuit is limited by the current source 206 or 216.

In FIG. 3, which shows examples of the voltages at the common electrode COM and the segment element SEG of the liquid crystal panel 104, in a selected mode, although the difference in voltage between the common electrode COM and the segment electrode SEG is the same (for example, VLCD−GND), its polarity is switched by the frame polarity signal FRAM (FRAM+, FRAM−). On the other hand, in a non-selected mode, although the difference in voltage between the common electrode COM and the segment electrode SEG is the same (VMIN), its polarity is switched by the frame polarity signal FRAM (FRAM+, FRAM−). Thus, the deterioration of liquid crystal of the liquid crystal panel 104 can be suppressed.

Figure 4:
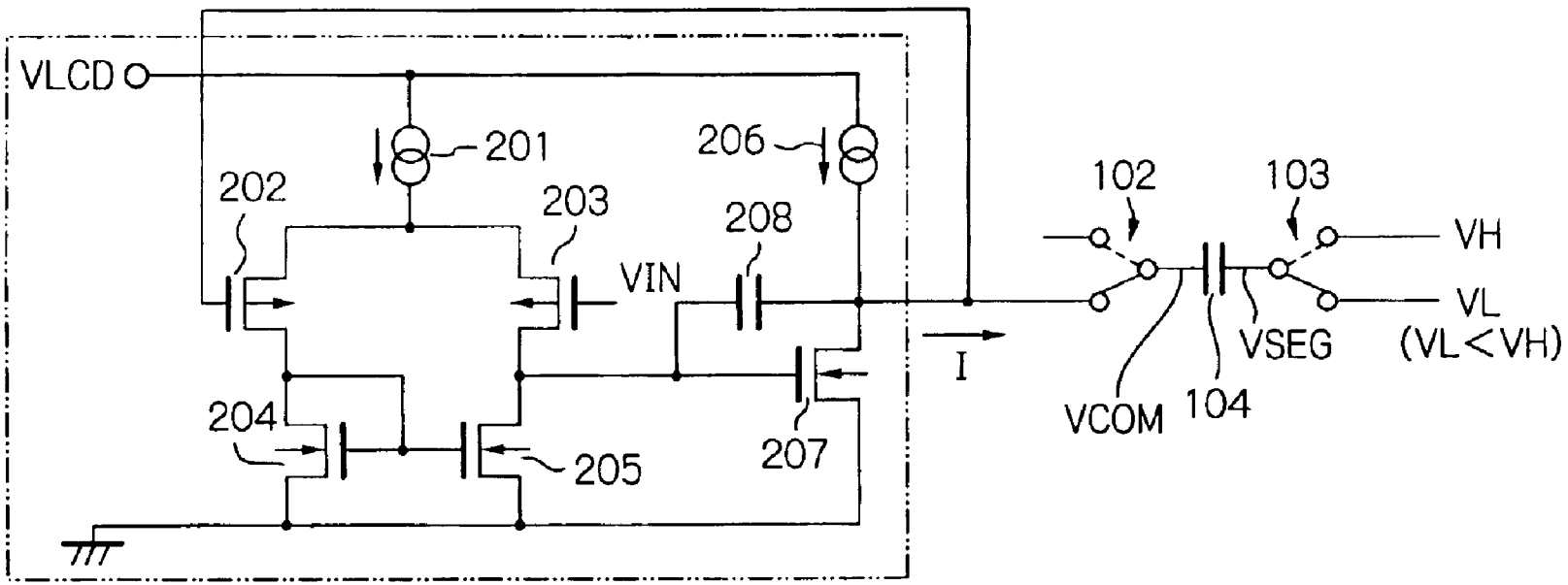
Fig. 4 PRIOR ART
FIG. 4 is a circuit diagram including the slow discharging amplifier of FIG. 2A.

The operation of the slow discharging amplifier of FIG. 2A will be explained next with reference to FIGS. 4 and 5. In FIG. 4, the slow discharging amplifier of FIG. 2A is connected by the decoder 102 to the liquid crystal panel 104 so that the voltage VCOM at the common electrode COM is VCOM=VIN while the voltage VSEG at the segment electrode SEG receives a voltage VL or VH via the decoder 103. In this case, the voltage (VCOM−VIN)-to-current I characteristics of the slow discharging amplifier of FIG. 4 are shown in FIG. 5. In FIG. 5, if VCOM>VIN, the current I is relatively large due to the turning-ON of the transistor 207. On the other hand, if VCOM≦VIN, the current I is limited by the current source 206 while the transistor 207 is turned OFF.

Figure 6:
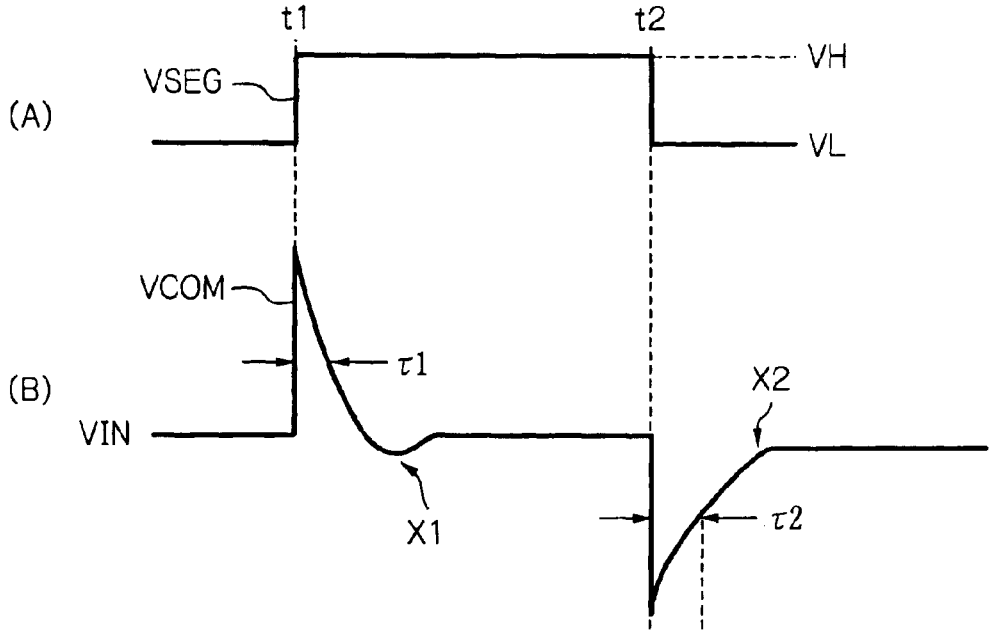
Fig. 6 PRIOR ART
FIG. 6 is a timing diagram for explaining the operation of the slow discharging amplifier of FIG. 4.

Next, the transient characteristics of the voltage VCOM of FIG. 4 are explained with reference to FIG. 6.

First, at time t1, when the voltage VSEG is increased by the decoder 103 from VL to VH, the voltage VCOM is also increased by the capacitive coupling. In this case, the slow discharging amplifier is operated, i.e., the transistor 207 is turned ON to increase the backward current I, so that the voltage VCOM slowly recovers its original level VIN with a time τ1. In this case, a small undershoot as indicated X1 is generated.

Next, at time t2, when the voltage VSEG is decreased by the decoder 103 from VH to VL, the voltage VCOM is also decreased by the capacitive coupling. In this case, the slow discharging amplifier is operated, i.e., the transistor 207 is turned OFF, so that the voltage VCOM very slowly recovers its original level VIN with a time τ2 which depends the current value of the current source 206. Since the current value of the current source 206 is limited, as shown in FIG. 6, the time τ2 is larger than the time τ1. Therefore, no substantial overshoot as indicated by X2 is generated.

Figure 7:
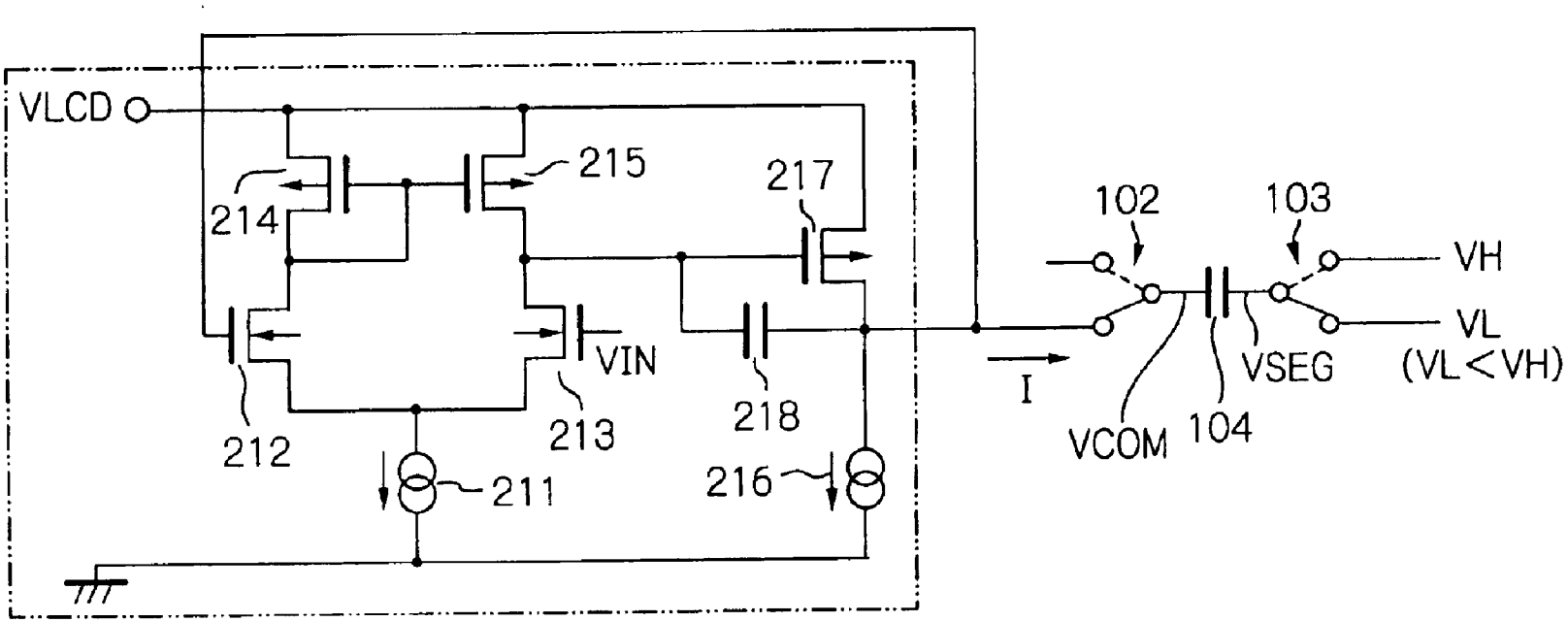
Fig. 7 PRIOR ART
FIG. 7 is a circuit diagram including the slow charging amplifier of FIG. 2B.
Figure 8:
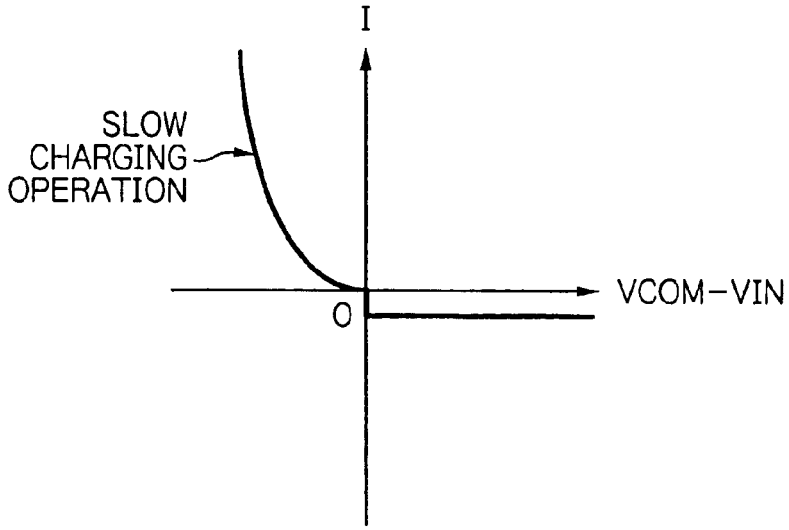
Fig. 8 PRIOR ART
FIG. 8 is a graph showing the voltage-to-current characteristics of the slow charging amplifier of FIG. 7.

The operation of the slow charging amplifier of FIG. 2B will be explained next with reference to FIGS. 7 and 8. In FIG. 7, the slow charging amplifier of FIG. 2B is connected by the decoder 102 to the liquid crystal panel 104 so that the voltage VCOM at the common electrode COM is VCOM=VIN while the voltage VSEG at the segment electrode SEG receives a voltage VL or VH via the decoder 103. In this case, the voltage (VCOM−VIN)-to-current I characteristics of the slow charging amplifier of FIG. 7 are shown in FIG. 8. In FIG. 8, if VCOM<VIN, the current I is relatively large due to the turning-ON of the transistor 217. On the other hand, if VCOM≧VIN, the current I is limited by the current source 216 while the transistor 217 is turned OFF.

Figure 9:
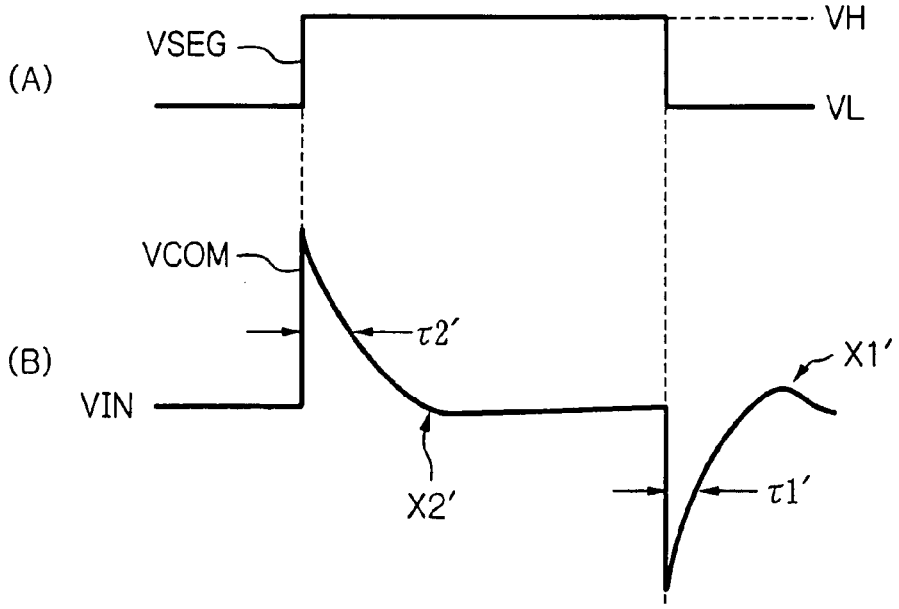
Fig. 9 PRIOR ART
FIG. 9 is timing diagram for explaining the operation of the slow charging amplifier of FIG. 7.

Next, the transient characteristics of the voltage VCOM of FIG. 7 are explained with reference to FIG. 9.

First, at time t1, when the voltage VSEG is increased by the decoder 103 from VL to VH, the voltage VCOM is also increased by the capacitive coupling. In this case, the slow charging amplifier is operated, i.e., the transistor 217 is turned OFF, so that the voltage VCOM very slowly recovers its original level VIN with a time τ2' using the current source 216. In this case, no substantial undershoot as indicated by X2' is generated.

Next, at time t2, when the voltage VSEG is decreased by the decoder 103 from VH to VL, the voltage VCOM is also decreased by the capacitive coupling. In this case, the slow charging amplifier is operated, i.e., the transistor 217 is turned ON to increase the forward current I, so that the voltage VCOM slowly recovers its original level VIN with a time τ1'. IN this case, a small overshoot as indicated by X1' is generated.

The time τ2' depends the current value of the current source 216. Since the current value of the current source 216 is limited, as shown in FIG. 9, the time τ2' is larger than the time τ1'.

In order to suppress the fluctuation of the times τ2 and τ2', the capacitors C0, C1, C2, C3 and C4 are externally provided in the LCD driving apparatus of FIG. 1, since each of the capacitors C0, C1, C2, C3 and C4 has a relatively large capacitance. In this case, however, the LCD driving apparatus of FIG. 1 is increased in size and cost.

Figure 10:
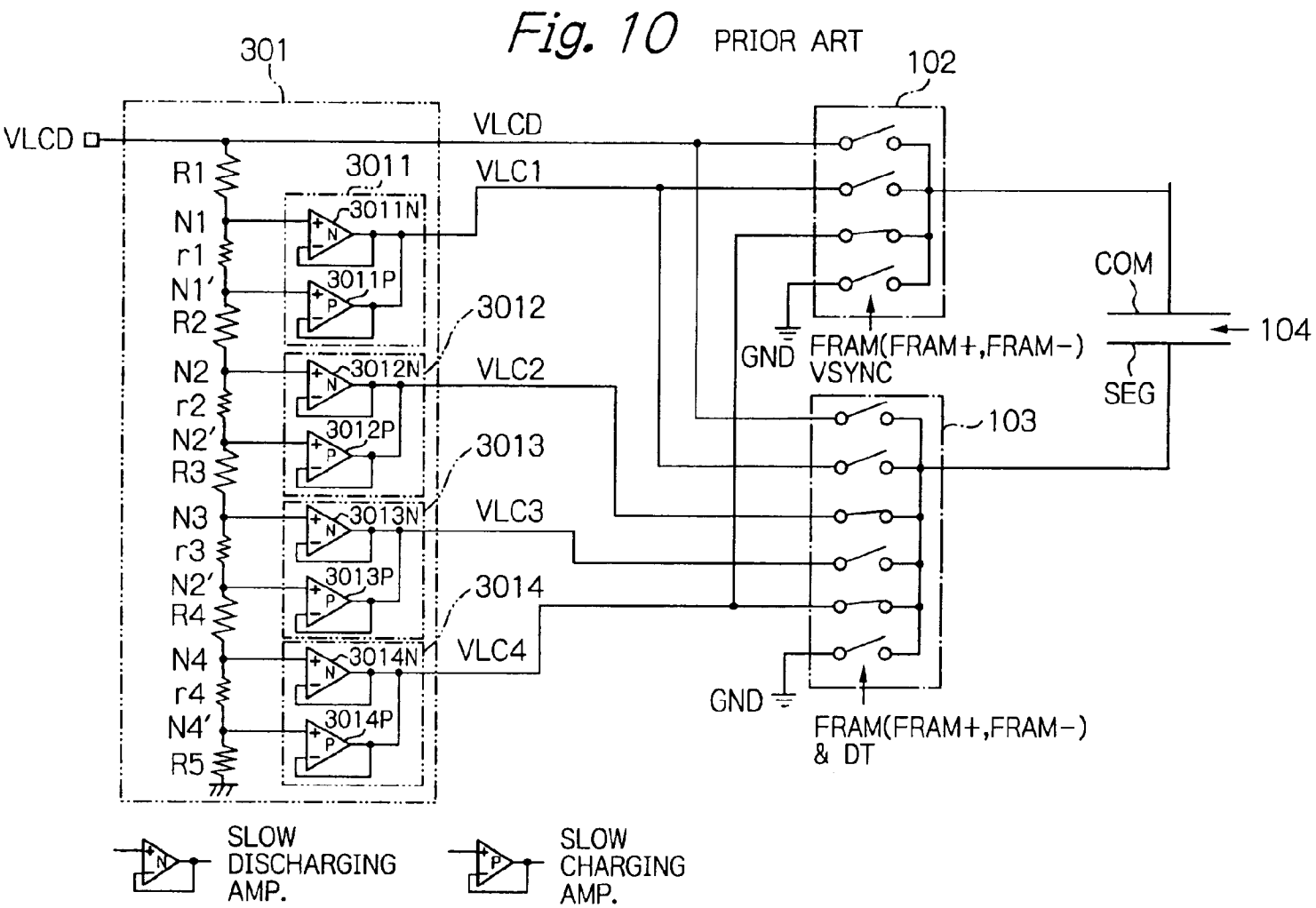
FIG. 10 is a circuit diagram illustrating a second prior art LCD driving apparatus.

In FIG. 10, which illustrates a second prior art LCD driving apparatus (see: FIG. 3 of JP-A-10-232383 and FIG. 7 of JP-A-2000-20147), the gradation voltage generating circuit 101 of FIG. 1 is replaced by a gradation voltage generating circuit 301.

Figure 11:
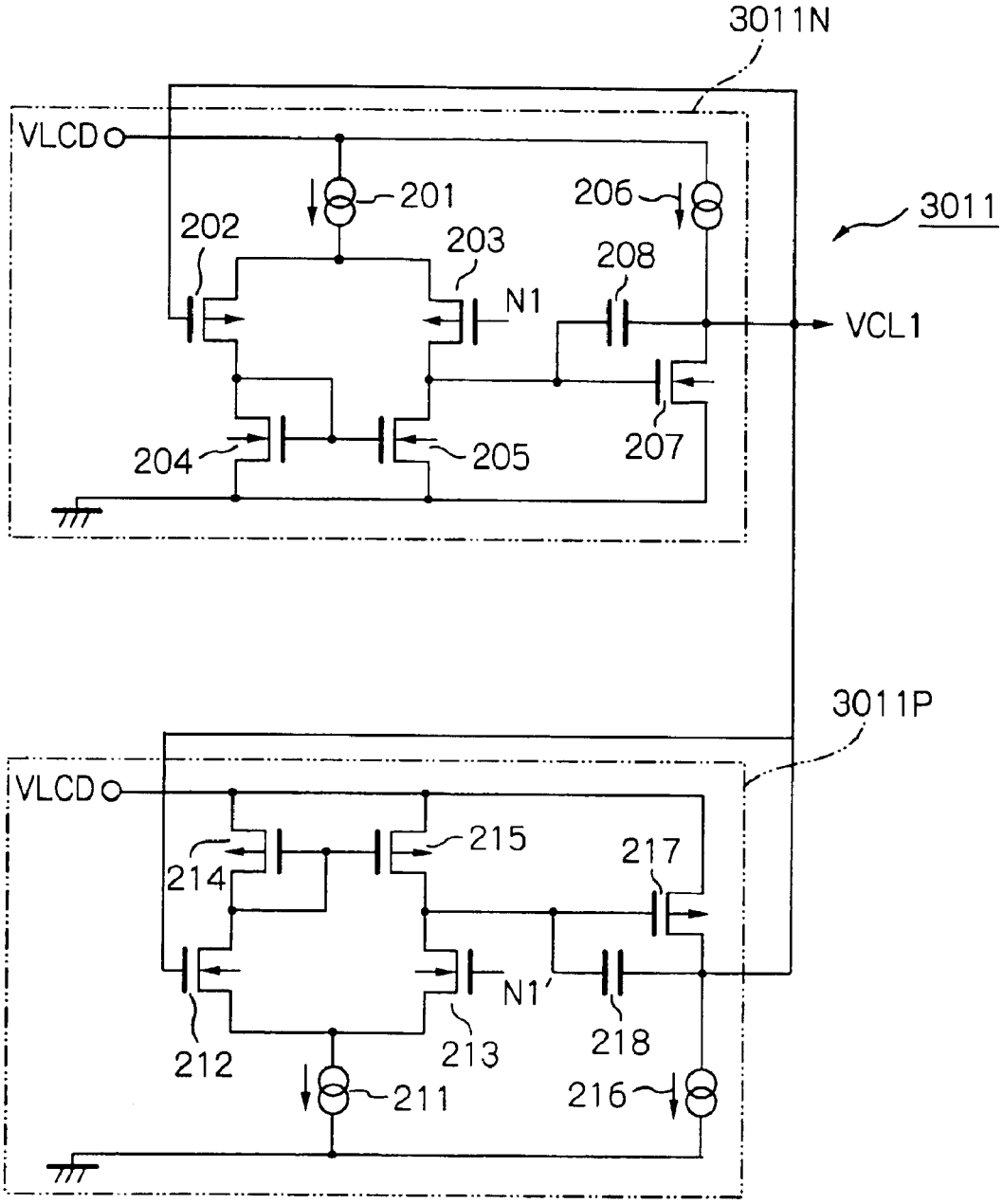
Fig. 11 PRIOR ART
FIG. 11 is a circuit diagram of the push-pull type amplifier of FIG. 10.

In the gradation voltage generating circuit 301, resistors r1, r2, r3 and r4 for generating offset voltages are inserted in series with the resistors R1, R2, R3, R4 and R5 of FIG. 1. Also, the single-end-type voltage-follower-type amplifiers 1011, 1012, 1013 and 1014 of FIG. 1 are replaced by push-pull type amplifiers 3011, 3012, 3013 and 3014, respectively. Each of the push-pull type amplifiers 3011, 3012, 3013 and 3014 is constructed by a slow discharging amplifier such as 3011N and a slow charging amplifier 3011P as illustrated in FIG. 11. Note that the resistance values of the resistors r1, r2, r3 and r4 are smaller than those of the resistors R1, R2, R3, R4 and R5, and therefore, an offset voltage ΔV is generated between the nodes N1 and N1', between the nodes N2 and N2', between the nodes N3 and N3', and between the nodes N4 and N4'.

In FIG. 10, the externally-provided capacitors C0, C1, C2, C3 and C4 of FIG. 1 are not provided, which would decrease the LCD driving apparatus of FIG. 8 in size and cost.

In FIG. 11, the slow discharging amplifier such as 3011N has the same configuration as the slow discharging amplifier of FIG. 2A, and the slow charging amplifier such as 3011P has the same configuration as the slow charging amplifier of FIG. 2B. That is, the two single end type amplifiers are combined into a push-pull type amplifier.

Figure 12:
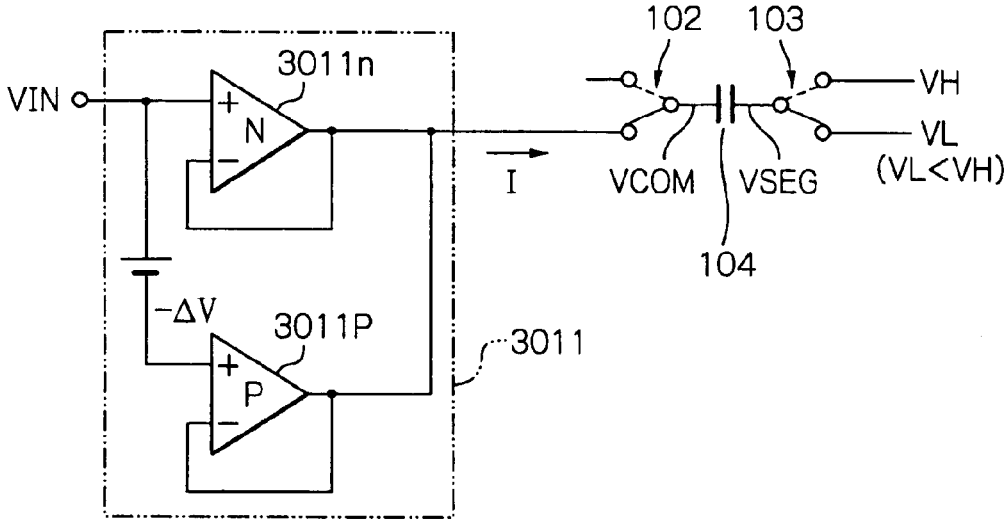
Fig. 12 PRIOR ART
FIG. 12 is a circuit diagram including the push-pull type amplifier of FIG. 11.
Figure 13:
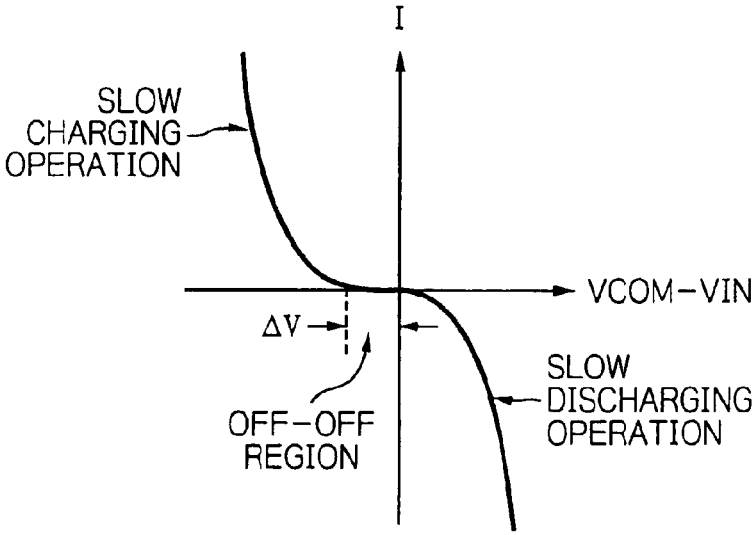
Fig. 13 PRIOR ART
FIG. 13 is a graph showing the voltage-to-current characteristics of the push-pull type amplifier of FIG. 12.

The operation of the push-pull type amplifier of FIG. 11 will be explained next with reference to FIGS. 12 and 13. In FIG. 12, the push-pull type amplifier of FIG. 11 is connected by the decoder 102 to the liquid crystal panel 104 so that the voltage VCOM at the common electrode COM is VCOM=VIN while the voltage VSEG at the segment electrode SEG receives a voltage VL or VII via the decoder 103. In this case, the voltage (VCOM−VIN)-to-current I characteristics of the push-pull type amplifier of FIG. 12 are shown in FIG. 13. In FIG. 13, if VCOM>VIN, the current I is relatively large due to the turning-ON of the transistor 207 of FIG. 11. On the other hand, if VCOM<VIN−ΔV where ΔV is the offset voltage, the current I is relatively large due to the turning-ON of the transistor 217.

Next, the transient characteristics of the voltage VCOM of FIG. 12 are explained with reference to FIG. 14.

First, at time t1, when the voltage VSEG is increased by the decoder 103 from VL to VH, the voltage VCOM is also increased by the capacitive coupling. In this case, the slow discharging amplifier 3011N is operated, i.e., the transistor 207 is turned ON to increase the backward current I, so that the voltage VCOM slowly recovers its original level VIN with a time τ1. In this case, a small undershoot as indicated by X1 is generated.

Next, at time t2, when the voltage VSEG is decreased by the decoder 103 from VH to VL, the voltage VCOM is also decreased by the capacitive coupling. In this case, the slow charging 3011P amplifier is operated, i.e., the transistor 217 is turned ON to increase the forward current I, so that the voltage VCOM slowly recovers its original level VIN with a time τ1'. In this case, a small overshoot as indicated by X1' is generated.

Figure 14:
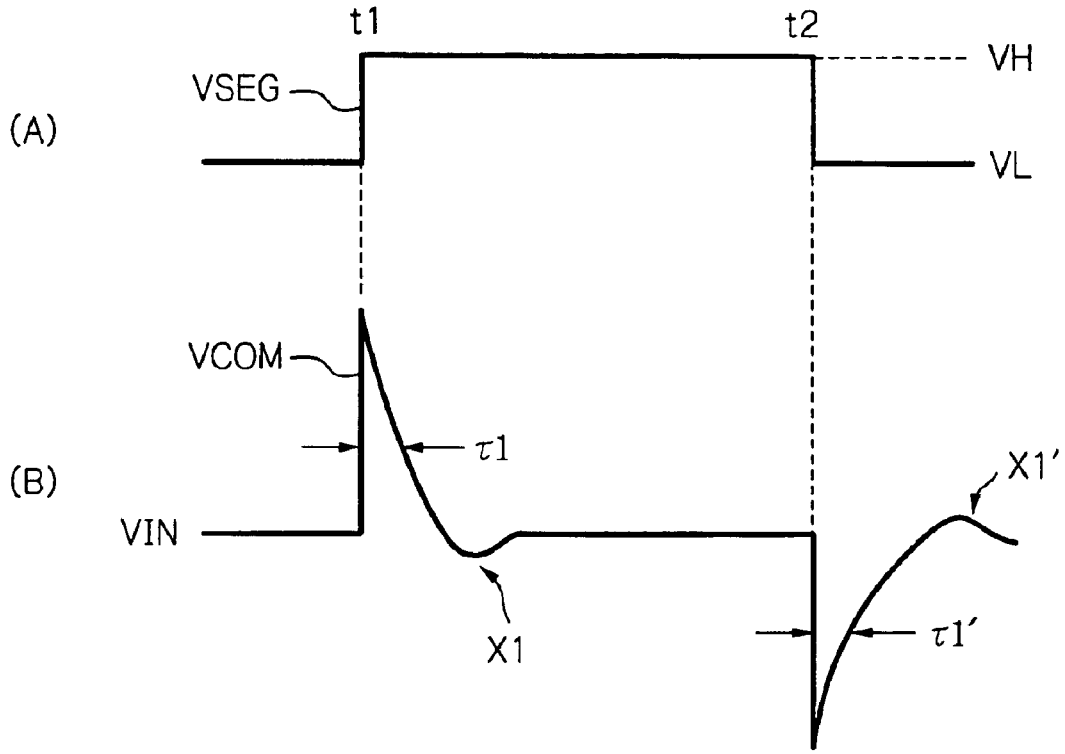
Fig. 14 PRIOR ART
FIG. 14 is a timing diagram for explaining the operation of the push-pull type amplifier of FIG. 12.

Note that, in FIG. 14, if the offset voltage ΔV is very small, no consideration can be given to the offset voltage ΔV. However, the offset voltage ΔV is indispensable in order to prevent the transistors 207 and 217 from being simultaneously turned ON to create a short-circuited state where an ON-ON current flows.

In the LCD driving apparatus of FIG. 10, however, the discharging amplifier and the charging amplifier forming one push-pull type amplifier are both of a slow type including the capacitors 208 and 218 of FIG. 11, so that the transient response as shown in FIG. 14 is still slow which would invite flicker.

Figure 15:
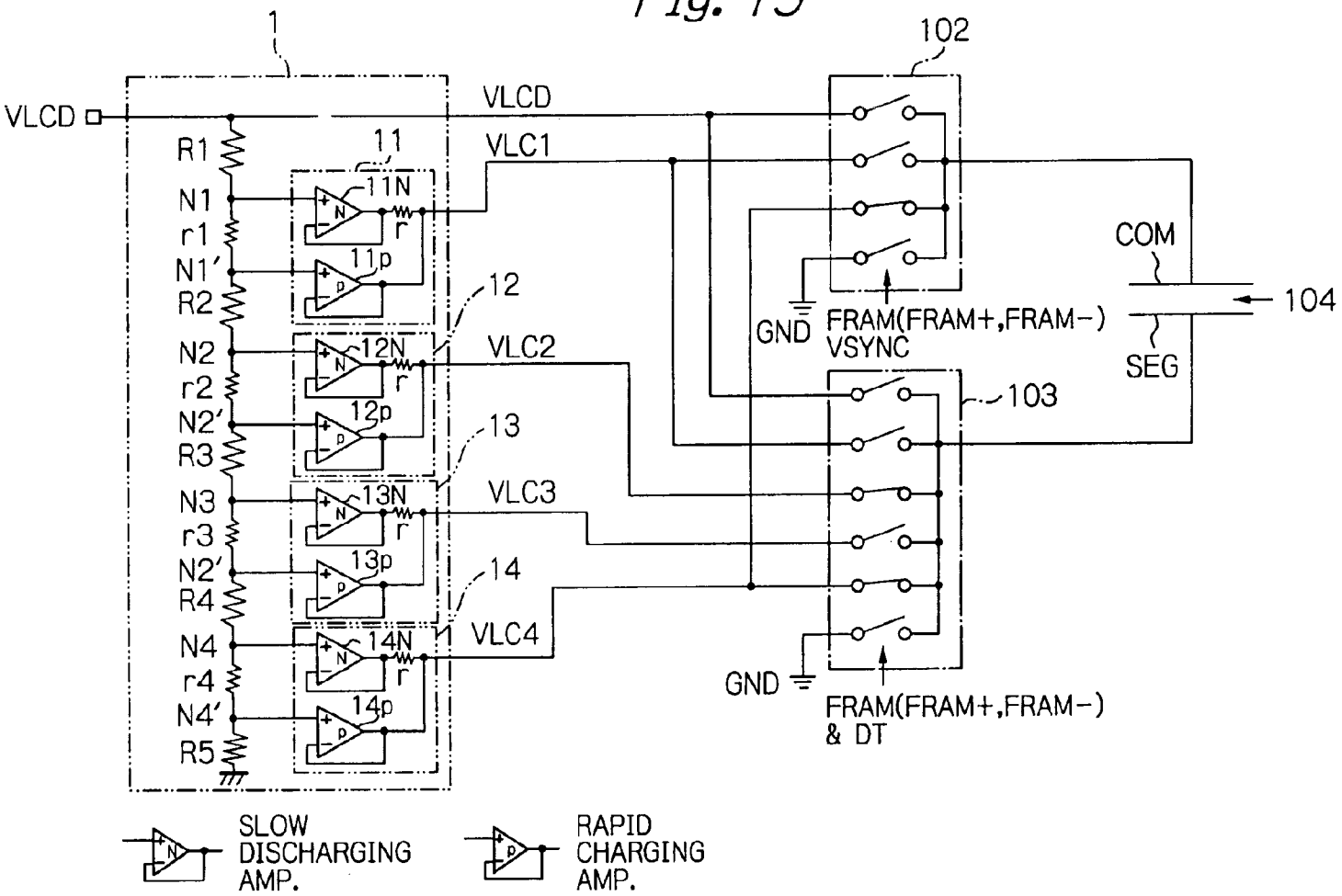
FIG. 15 is a circuit diagram illustrating a first embodiment of the LCD driving apparatus according to the present invention.

In FIG. 15, which illustrates a first embodiment of the LCD driving apparatus according to the present invention, the gradation voltage generating circuit 301 of FIG. 10 is replaced by a gradation voltage generating circuit 1.

Figure 16:
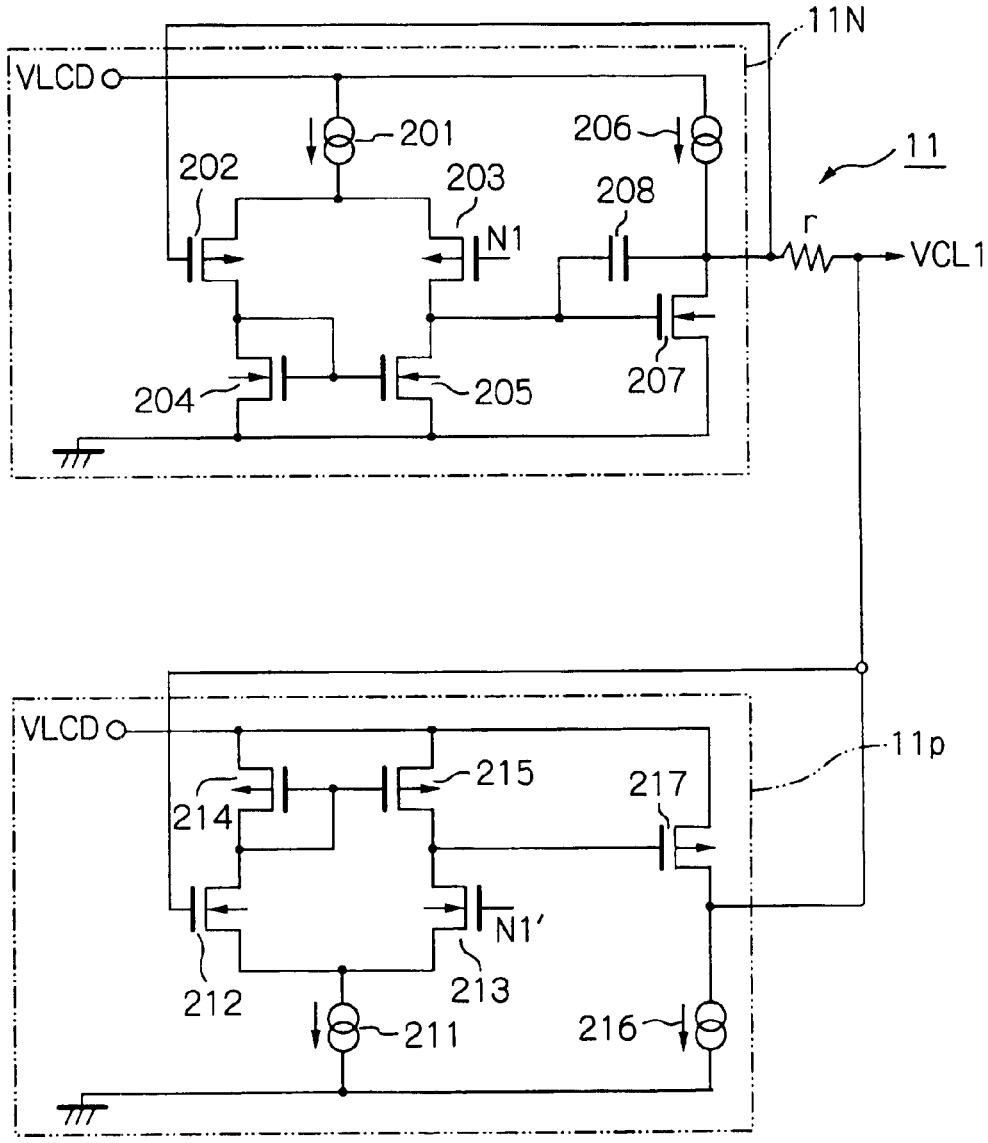
FIG. 16 is a circuit diagram of the push-pull type amplifier of FIG. 15.

In the gradation voltage generating circuit 1, the push-pull type amplifiers 3011, 3012, 3013 and 3014 of FIG. 10 are replaced by push-pull type amplifiers 11, 12, 13 and 14, respectively. Each of the push-pull type amplifiers 11, 12, 13 and 14 is constructed by a slow discharging amplifier such as 11N and a rapid charging amplifier 11*p* as illustrated in FIG. 16. Note that a resistor r is used for suppressing an ON-ON current when the transistors 207 and 217 or FIG. 16 are both turned ON.

In FIG. 16, the slow discharging amplifier such as 11N has the same configuration as the slow discharging amplifier of FIG. 11, and the rapid charging amplifier such as 11P has the same configuration as the slow charging amplifier of FIG. 11 except that the capacitor 218 is not provided.

Figure 17:
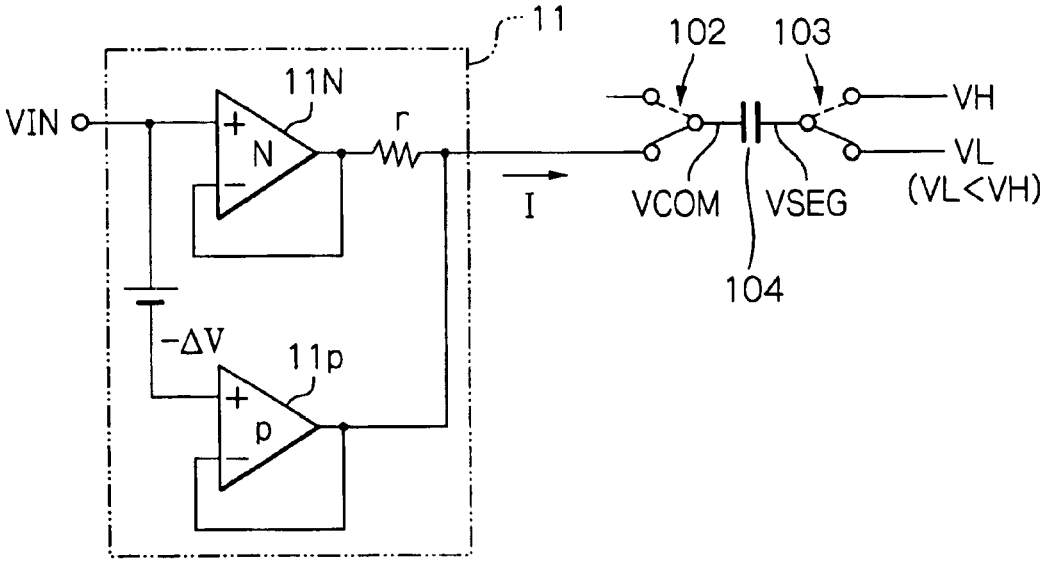
FIG. 17 is a circuit diagram including the push-pull type amplifier of FIG. 16.
Figure 18:
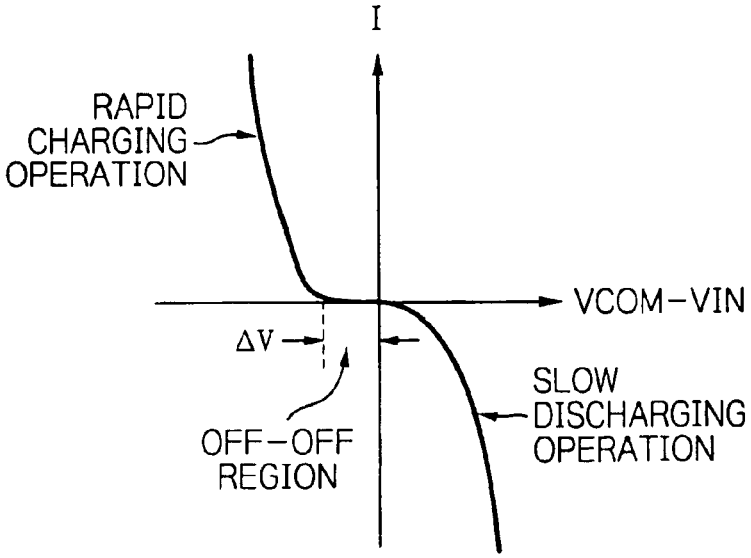
FIG. 18 is a graph showing the voltage-to-current characteristics of the push-pull type amplifier of FIG. 17.

The operation of the push-pull type amplifier of FIG. 16 will be explained next with reference to FIGS. 17 and 18. In FIG. 17, the push-pull type amplifier of FIG. 16 is connected by the decoder 102 to the liquid crystal panel 104 so that the voltage VCOM at the common electrode COM is VCOM= VIN while the voltage VSEG at the segment electrode SEG receives a voltage VL or VH via the decoder 103. In this case, the voltage (VCOM−VIN)-to-current I characteristics of the push-pull type amplifier of FIG. 17 are shown in FIG. 18. In FIG. 13, if VCOM>VIN, the current I is relatively large due to the turning-ON of the transistor 207 of FIG. 16. On the other hand, if VCOM<VIN−ΔV where ΔV is the offset voltage, the current I is very large due to the turning-ON of the transistor 217, since the capacitor 218 is not provided.

Note that the rapid charging amplifier 11*p* may easily oscillate; in this case, however, since the rapid charging amplifier 11*p* is connected to the slow discharging amplifier 11N which may hardly oscillate, the rapid charging amplifier 11*p* hardly oscillates.

Next, the transient characteristics of the voltage VCOM of FIG. 17 are explained with reference to FIG. 19.

First, at time t1, when the voltage VSEG is increased by the decoder 103 from VL to VH, the voltage VCOM is also increased by the capacitive coupling. In this case, the slow discharging amplifier 11N is operated, i.e., the transistor 207 is turned ON to increase the backward current I, so that the voltage VCOM slowly recovers its original level VIN with a time τ1. In this case, a small undershoot as indicated by X1 is generated.

Next, at time t2, when the voltage VSEG is decreased by the decoder 103 from VH to VL, the voltage VCOM is also decreased by the capacitive coupling. In this case, the rapid charging amplifier 11*p* is operated, i.e., the transistor 217 is turned ON to increase the forward current I, so that the voltage VCOM rapidly recovers its original level VIN with a time τ0'. In this case, a large overshoot may be generated; however, no substantial overshoot as indicated by X0' is generated due to the presence of the offset voltage ΔV.

Figure 19:
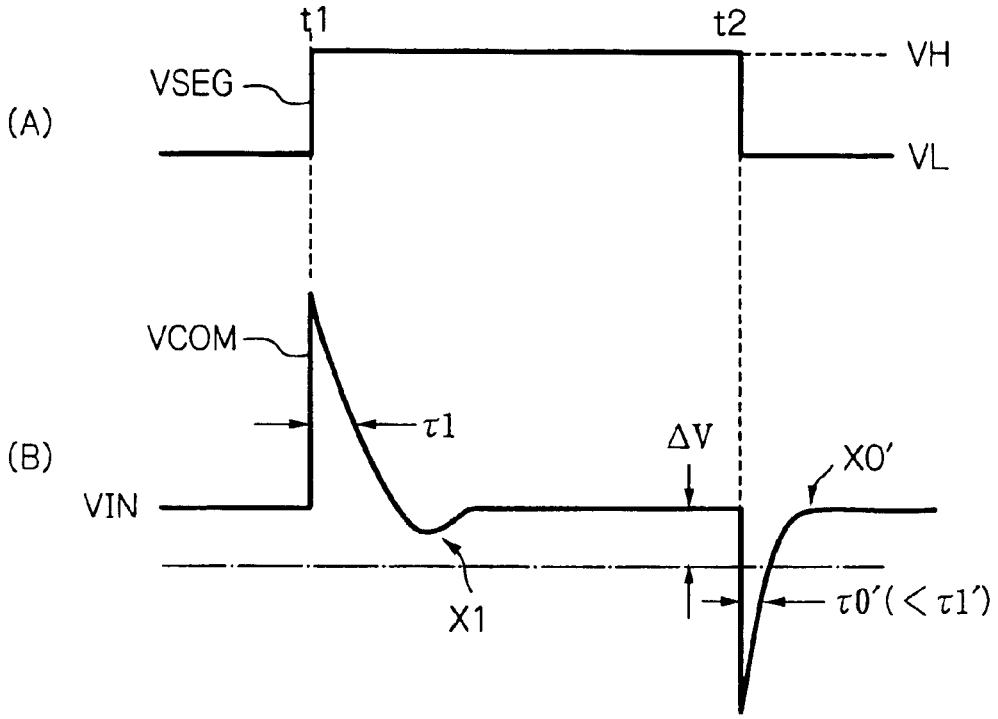
FIG. 19 is a timing diagram for explaining the operation of the push-pull type amplifier of FIG. 17.

Thus, in the LCD driving apparatus of FIG. 15, the charging amplifier forming one push-pull type amplifier is of a rapid type, the transient response as shown in FIG. 19 is rapid which would invite no flicker.

Figure 20:
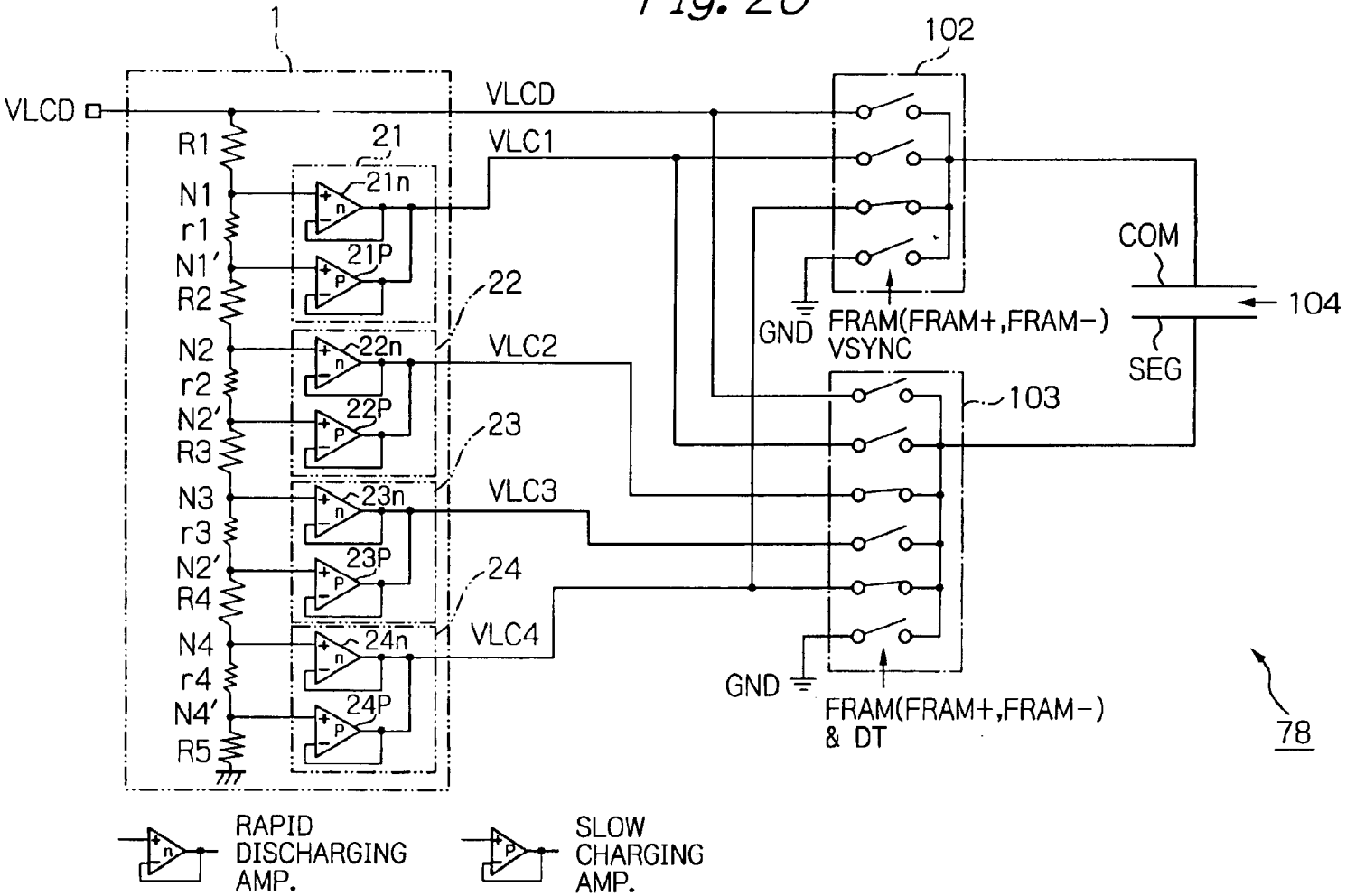
FIG. 20 is a circuit diagram illustrating a second embodiment of the LCD driving apparatus according to the present invention.

In FIG. 20, which illustrates a second embodiment of the LCD driving apparatus according to the present invention, the gradation voltage generating circuit 301 of FIG. 10 is replaced by a gradation voltage generating circuit 2.

Figure 21:
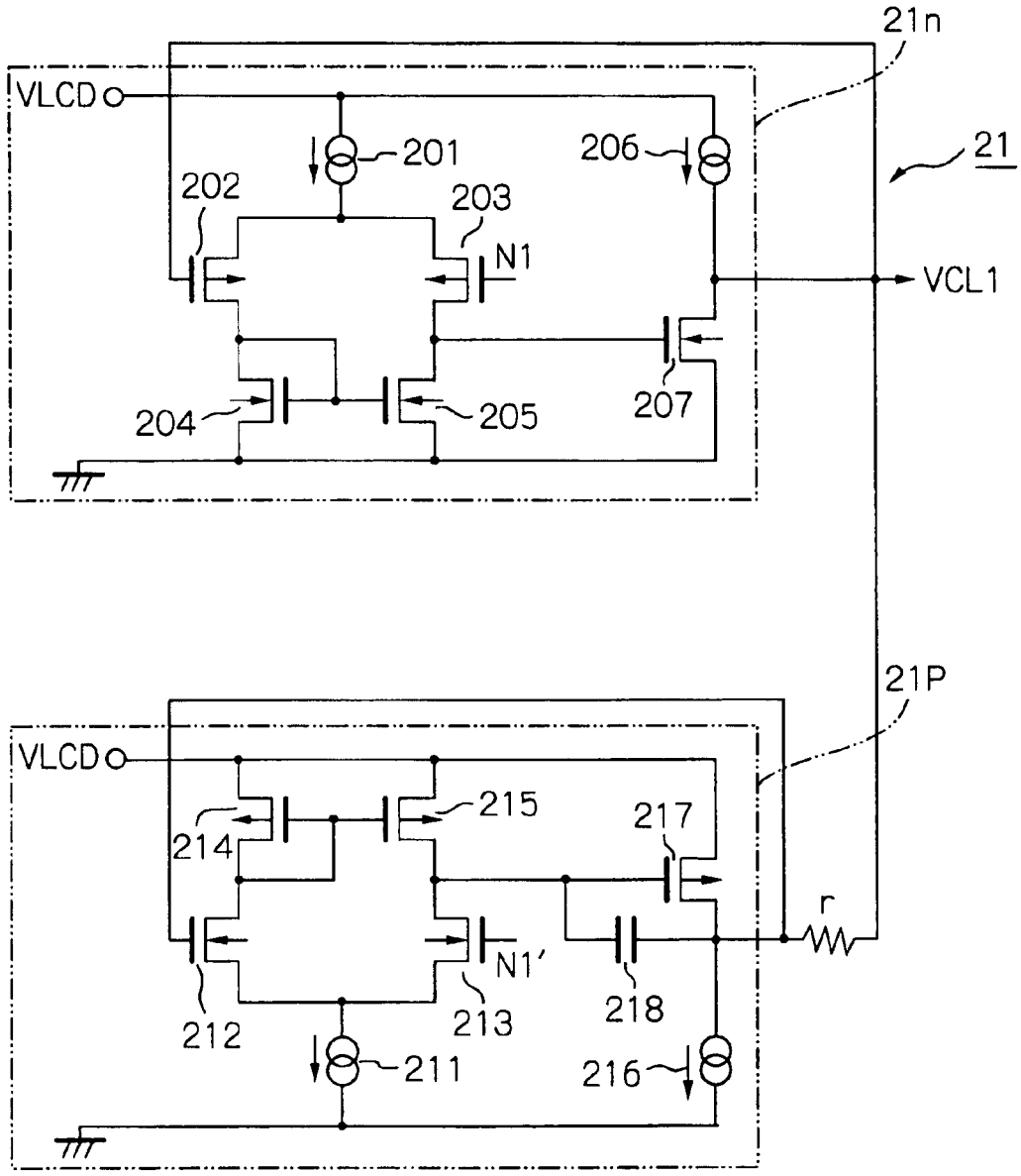
FIG. 21 is a circuit diagram of the push-pull type amplifier of FIG. 20.

In the gradation voltage generating circuit 2, the push-pull type amplifiers 3011, 3012, 3013 and 3014 of FIG. 10 are replaced by push-pull type amplifiers 21, 22, 23 and 24, respectively. Each of the push-pull type amplifiers 21, 22, 23 and 24 is constructed by a rapid discharging amplifier such as 21*n* and a slow charging amplifier 21P as illustrated in FIG. 21. Note that a resistor r is used for suppressing an ON-ON current when the transistors 207 and 217 or FIG. 21 are both turned ON.

In FIG. 21, the rapid discharging amplifier such as 21*n* has the same configuration as the slow discharging amplifier of FIG. 11 except that the capacitor 208 is not provided, and the slow charging amplifier such as 21P has the same configuration as the slow charging amplifier of FIG. 11.

Figure 22:
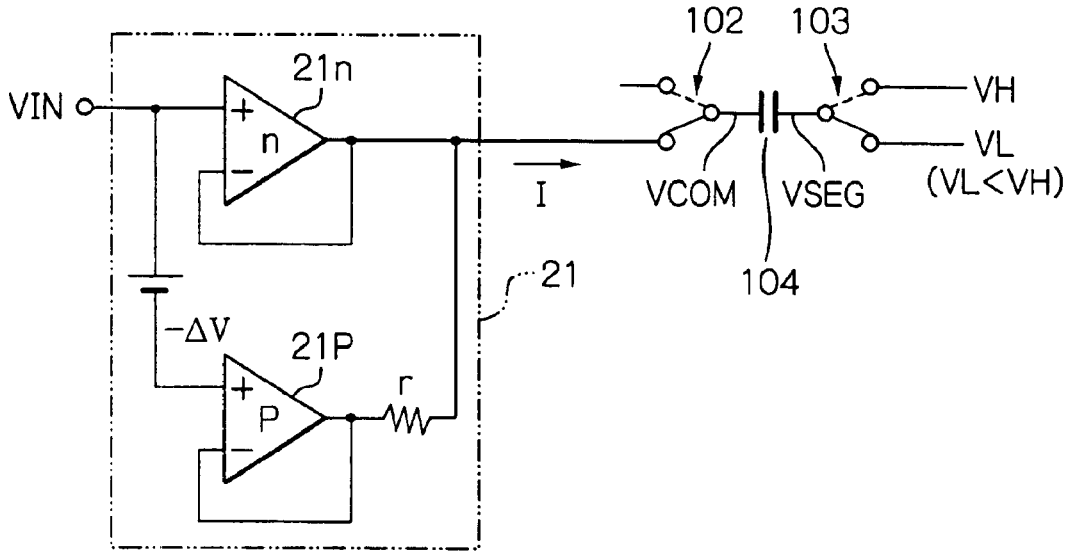
FIG. 22 is a circuit diagram including the push-pull type amplifier of FIG. 21.
Figure 23:
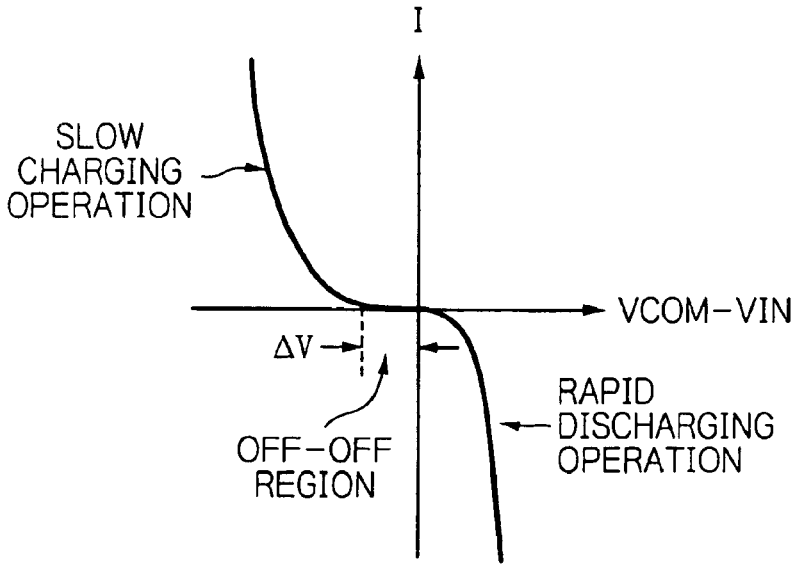
FIG. 23 is a graph showing the voltage-to-current characteristics of the push-pull type amplifier of FIG. 22.

The operation of the push-pull type amplifier of FIG. 21 will be explained next with reference to FIGS. 22 and 23. In FIG. 22, the push-pull type amplifier of FIG. 21 is connected by the decoder 102 to the liquid crystal panel 104 so that the voltage VCOM at the common electrode COM is VCOM= VIN while the voltage VSEG at the segment electrode SEG receives a voltage VL or VH via the decoder 103. In this case, the voltage (VCOM−VIN)-to-current I characteristics of the push-pull type amplifier of FIG. 22 are shown in FIG. 23. In FIG. 23, if VCOM>VIN, the current I is very large due to the turning-ON of the transistor 207 of FIG. 21, since the capacitor 208 is not provided. On the other hand, if VCOM<VIN−ΔV where ΔV is the offset voltage, the current I is relatively large due to the turning-ON of the transistor 217.

Note that the rapid discharging amplifier 21*n* may easily oscillate; in this case, however, since the rapid discharging amplifier 21*n* is connected to the slow charging amplifier 21P which may hardly oscillate, the rapid discharging amplifier 21*n* hardly oscillates.

Next, the transient characteristics of the voltage VCOM of FIG. 22 are explained with reference to FIG. 24.

First, at time t1, when the voltage VSEG is increased by the decoder 103 from VL to VH, the voltage VCOM is also increased by the capacitive coupling. In this case, the rapid discharging amplifier 21*n* is operated, i.e., the transistor 207 is turned ON to increase the backward current I, so that the voltage VCOM rapidly recovers its original level VIN with a time τ0 (<τ1). In this case, a large undershoot as indicated by X0 is generated.

Next, at time t2, when the voltage VSEG is decreased by the decoder 103 from VH to VL, the voltage VCOM is also decreased by the capacitive coupling. In this case, the slow charging 21P amplifier is operated, i.e., the transistor 217 is turned ON to increase the forward current I, so that the voltage VCOM slowly recovers its original level VIN with a time τ1'. In this case, an overshoot may be generated; however, no substantial overshoot as indicated in X1' is generated due to the presence of the offset voltage.

Figure 24:
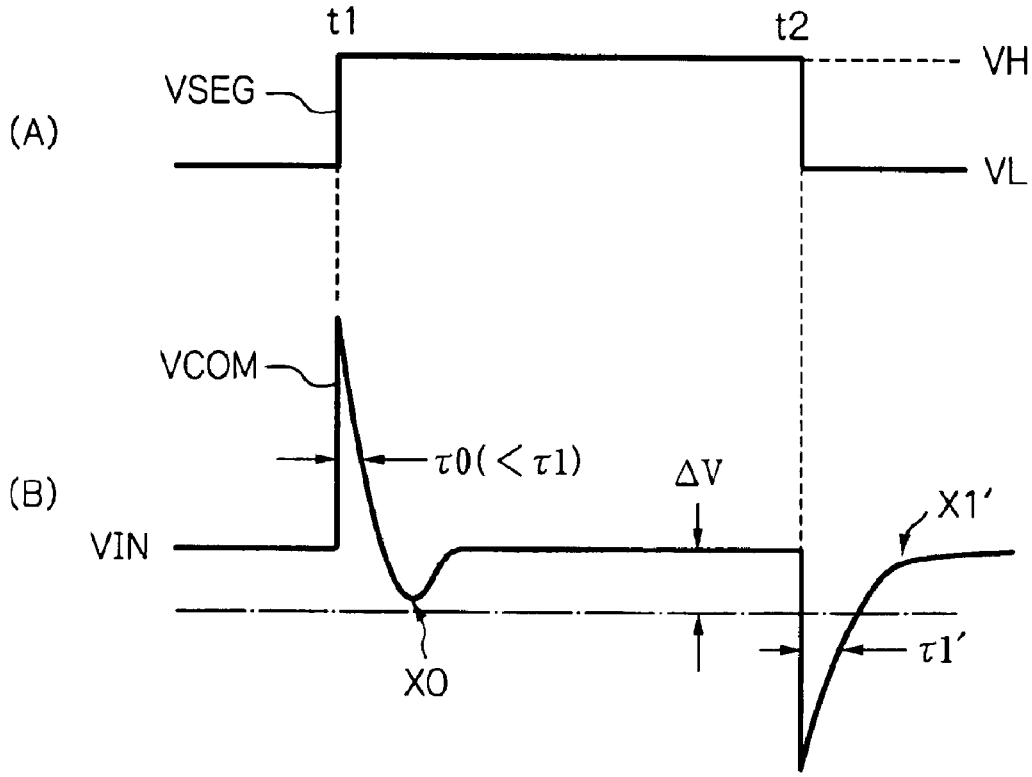
FIG. 24 is a timing diagram for explaining the operation of the push-pull type amplifier of FIG. 22.

Thus, in the LCD driving apparatus of FIG. 20, discharging amplifier forming one push-pull type amplifier is of a rapid type, the transient response as shown in FIG. 24 is rapid which would invite no flicker.

Figure 25:
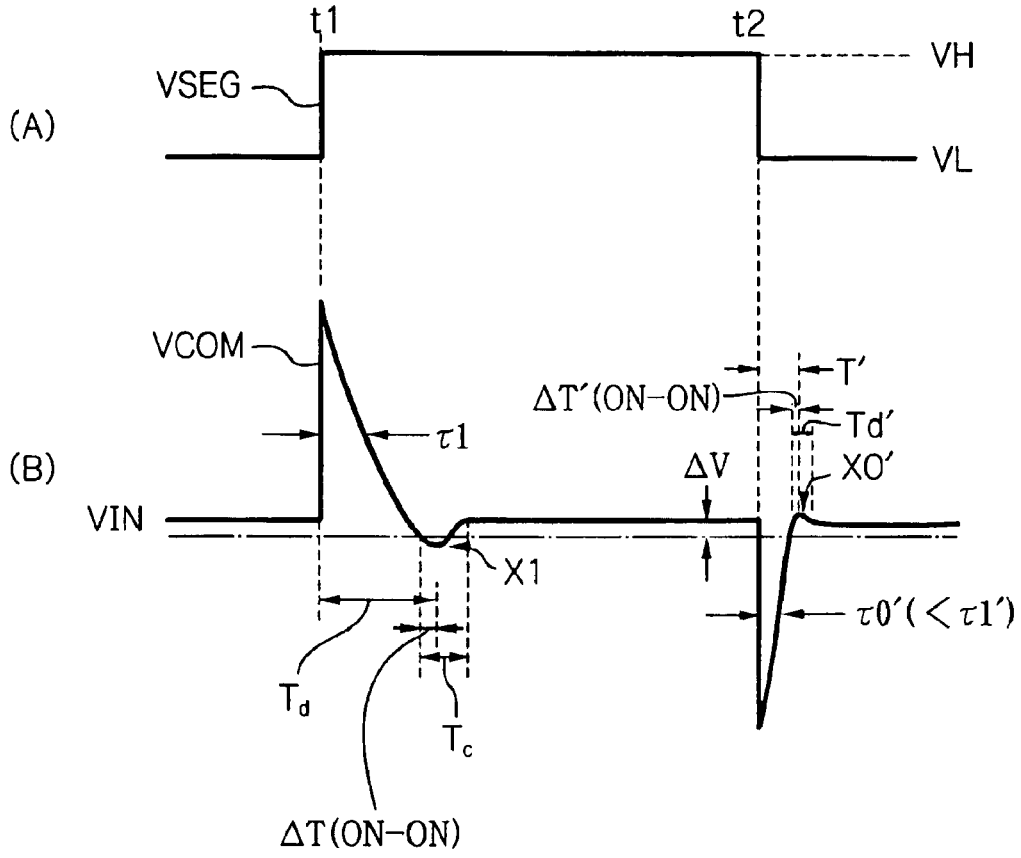
FIG. 25 is a timing diagram showing for explaining a modification of the operation of the push-pull type amplifier of FIG. 15.

In FIG. 19, when the offset voltage ΔV is decreased, the transient response speed can be increased as shown in FIG. 25. In this case, however, since the turning-ON period $T_d$ of the discharging transistor 207 of FIG. 16 is superimposed onto the turning-ON period $T_c$ of the charging transistor 217 of FIG. 16, an ON-ON current may flow therethrough during a period ΔT. Similarly, since the turning-ON period $T_c'$ of the charging transistor 217 of FIG. 16 is superimposed onto the turning-ON period $T_d'$ of the discharging transistor 207 of FIG. 16, an ON-ON current may flow therethrough during a period ΔT'.

Figure 26:
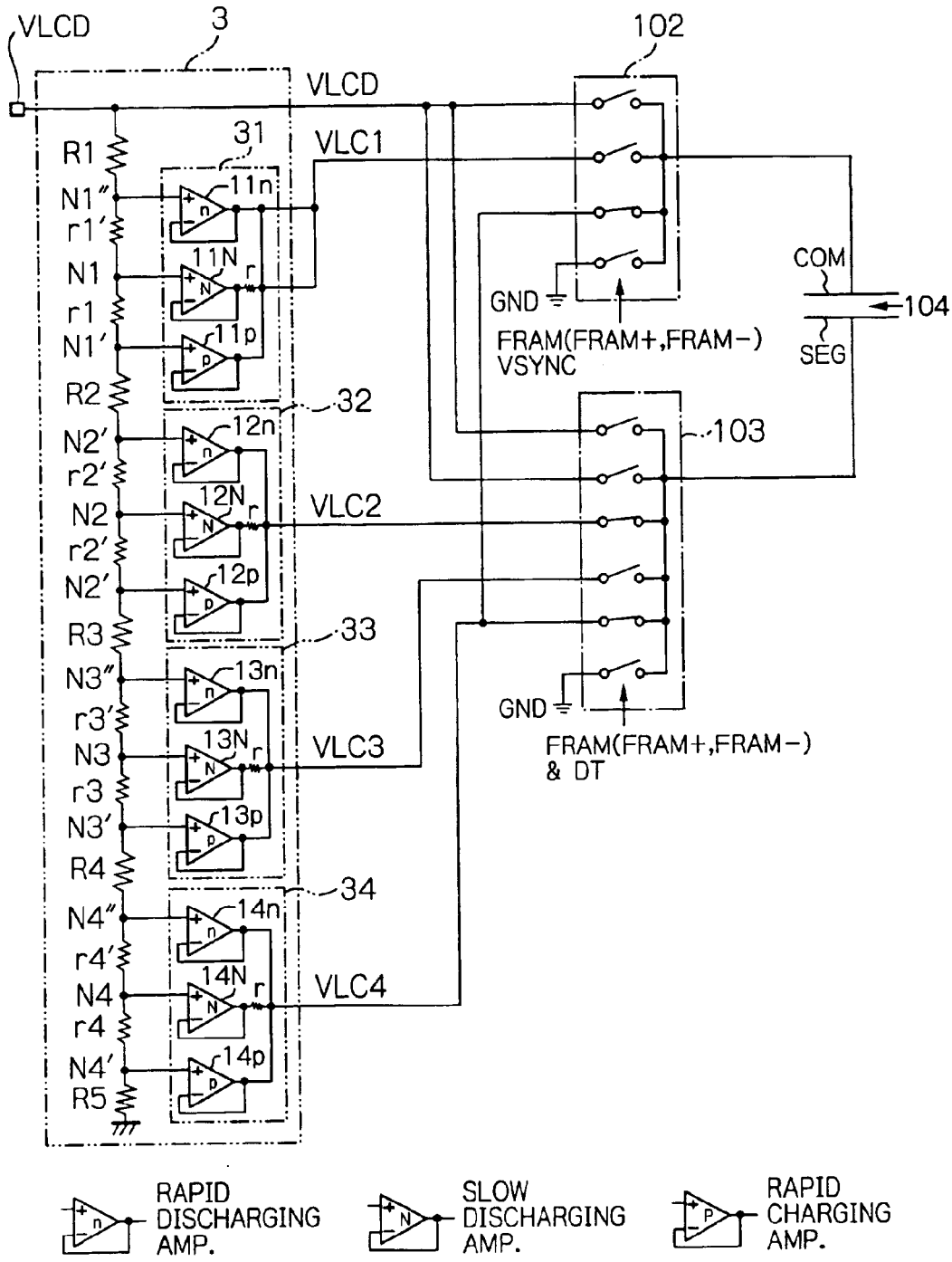
FIG. 26 is a circuit diagram illustrating a third embodiment of the LCD driving apparatus according to the present invention.

In FIG. 26, which illustrates a third embodiment of the LCD driving apparatus according to the present invention, the gradation voltage generating circuit 1 of FIG. 15 is replaced by a gradation voltage generating circuit 3.

In the gradation voltage generating circuit 3, resistors r1', r2', r3' and r4' for other offset voltages are inserted in series with the resistors R1, R2, R3 and R4 of FIG. 15. Also, the push-pull type amplifiers 11, 12, 13 and 14 of FIG. 15 are replaced by push-pull type amplifiers 31, 32, 33 and 34, respectively. Each of the push-pull type amplifiers 31, 32, 33 and 34 further includes a rapid discharging amplifier such as 11*n* in addition to the slow discharging amplifier such as 11N and the rapid charging amplifier 11*p* as illustrated in FIG. 27.

Figure 27:
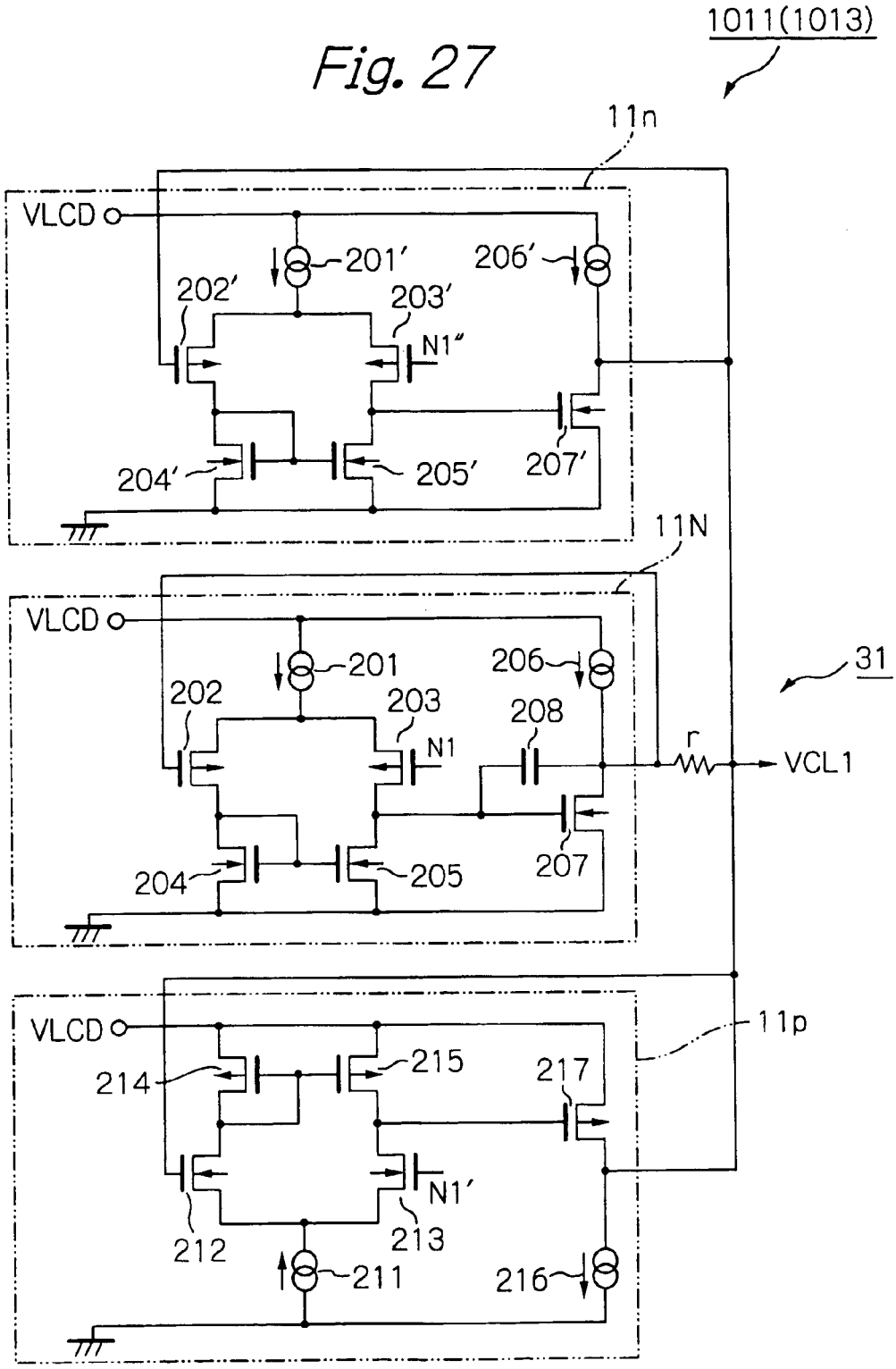
FIG. 27 is a circuit diagram of the push-pull type amplifier of FIG. 26.

In FIG. 27, the rapid discharging amplifier such as 11*n* has the same configuration as the slow discharging amplifier 11N except that the capacitor 208 is not provided.

Figure 28:
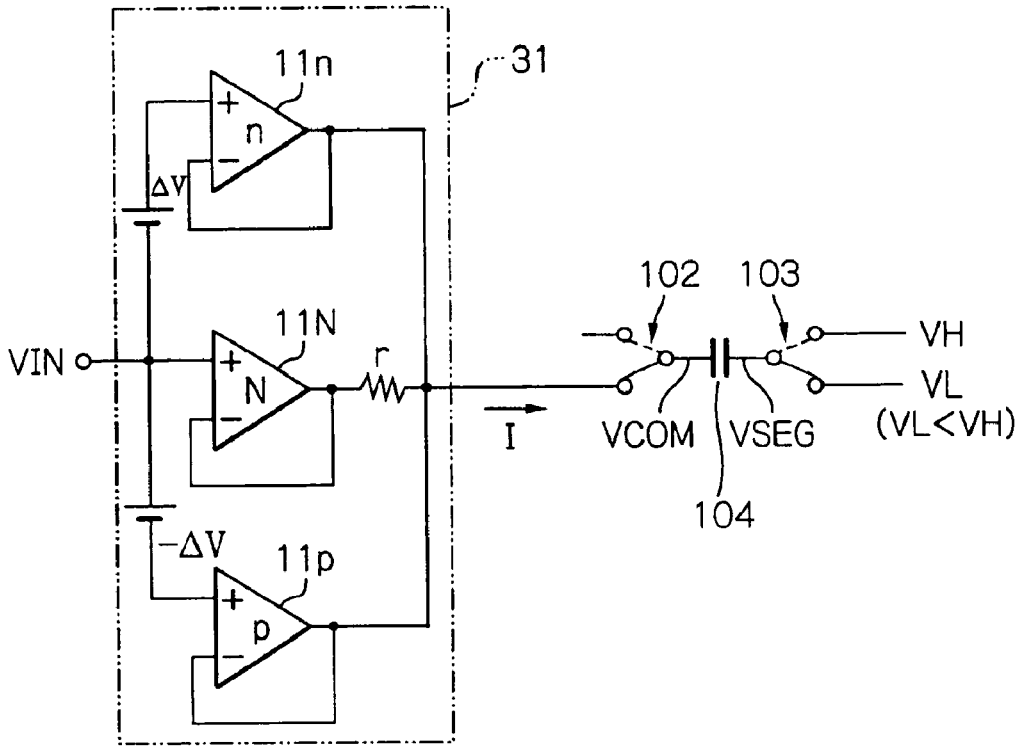
FIG. 28 is a circuit diagram including the push-pull type amplifier of FIG. 27.
Figure 29:
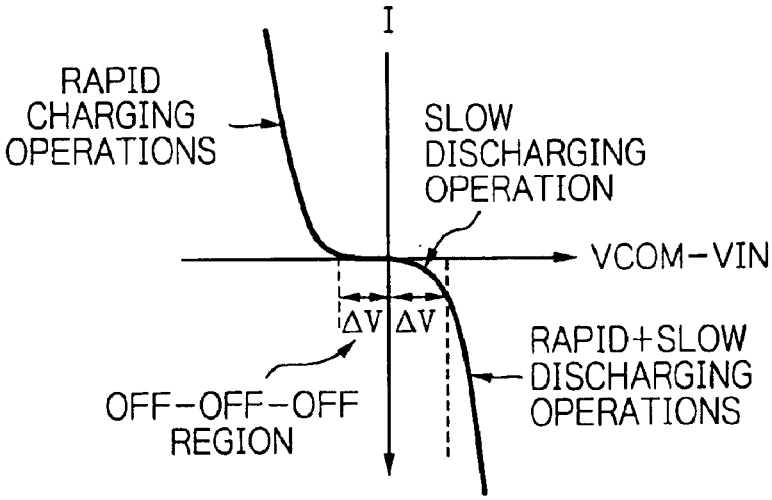
FIG. 29 is a graph showing the voltage-to-current characteristics of the push-pull type amplifier of FIG. 28.

The operation of the push-pull type amplifier of FIG. 27 will be explained next with reference to FIGS. 28 and 29. In FIG. 28, the push-pull type amplifier of FIG. 27 is connected by the decoder 102 to the liquid crystal panel 104 so that the voltage VCOM at the common electrode COM is VCOM=VIN while the voltage VSEG at the segment electrode SEG receives a voltage VL or VH via the decoder 103. In this case, the voltage (VCOM−VIN)-to-current I characteristics of the push-pull type amplifier of FIG. 28 are shown in FIG. 29. In FIG. 29, if VCOM>VIN, the current I is very large due to the turning-ON of the transistors 207 and 207' of FIG. 27. Also, if 0<VCOM−VIN≦ΔV, the current I is relatively large due to the turning-ON of the transistor 207 of FIG. 27. On the other hand, if VCOM<VIN−ΔV, the current I is very large due to the turning-ON of the transistor 217.

Note that the rapid amplifiers 11*p* and 11*n* may easily oscillate; in this case, however, since the rapid amplifiers 11*p* and 11*n* connected to the slow discharging amplifier 11N which may hardly oscillate, the rapid amplifiers 11*p* and 11*n* hardly oscillate.

Next, the transient characteristics of the voltage VCOM of FIG. 28 are explained with reference to FIG. 30.

First, at time t1 , when the voltage VSEG is increased by the decoder 103 from VL to VH, the voltage VCOM is also increased by the capacitive coupling. In this case, the rapid discharging amplifier 11*n* and the slow discharging amplifier 11N are operated, i.e., the transistors 207 and 207' are turned ON to increase the backward current I, so that the voltage VCOM very rapidly recovers its original level VIN with a time τ0. In this case, an undershoot as indicated by X0 is generated, however, afterward, the operation of the rapid discharging amplifier 11*n* is stopped, i.e., only the slow discharging amplifier 11N is operated. As a result, the undershoot as indicated by X0 is relatively small, so that the response speed is increased.

Next, at time t2 , when the voltage VSEG is decreased by the decoder 103 from VH to VL, the voltage VCOM is also decreased by the capacitive coupling. In this case, the rapid charging amplifier 11*p* is operated, i.e., the transistor 217 is turned ON to increase the forward current I, so that the voltage VCOM rapidly recovers its original level VIN with a time τ0'. In this case, a large overshoot may be generated; however, no substantial overshoot as indicated by X0' is generated due to the presence of the offset voltage ΔV.

Figure 30:
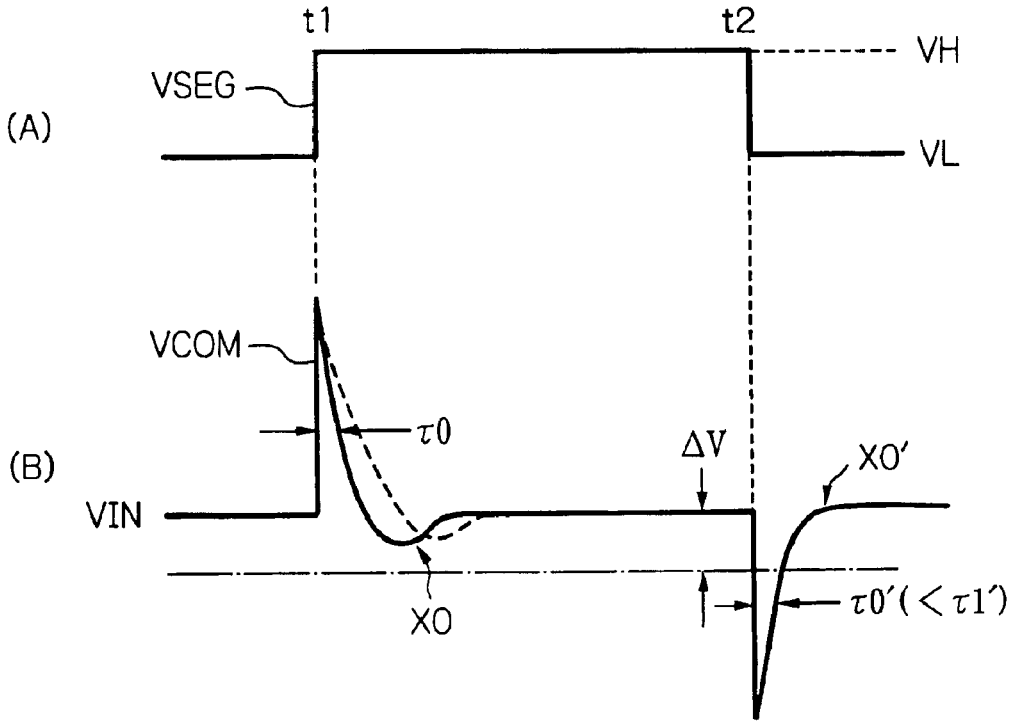
FIG. 30 is a timing diagram for explaining the operation of the push-pull type amplifier of FIG. 28.

Thus, in the LCD driving apparatus of FIG. 26, the discharging amplifiers and the charging amplifier forming one push-pull type amplifier are substantially of a rapid type, even if the offset voltage ΔV is large, the transient response as shown in FIG. 30 is rapid which would invite no flicker.

Figure 31:
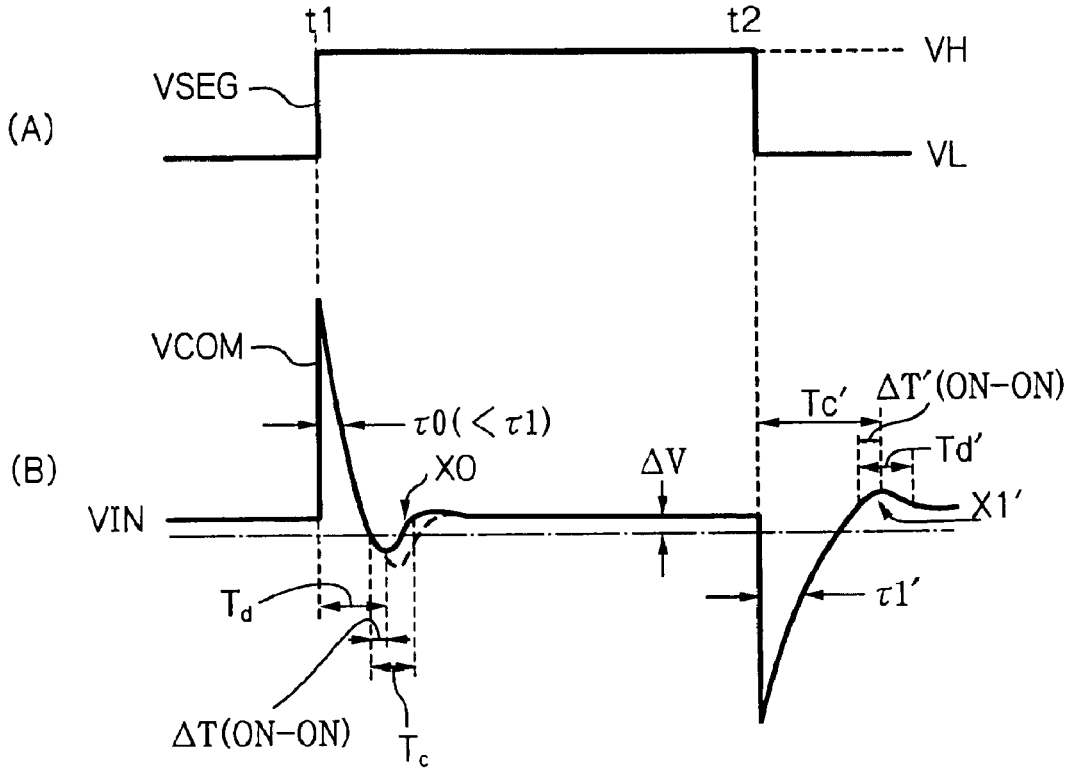
FIG. 31 is a timing diagram showing for explaining a modification of the operation of the push-pull type amplifier of FIG. 24.

In FIG. 24, when the offset voltage ΔV is decreased, the transient response speed can be increased as shown in FIG. 31. In this case, however, since the turning-ON period $T_d$ of the discharging transistor 207 of FIG. 21 is superimposed onto the turning-ON period $T_c$ of the charging transistor 217 of FIG. 16, an ON-ON current may flow therethrough during a period ΔT. Similarly, since the turning-ON period $T_c'$ of the charging transistor 217 of FIG. 21 is superimposed onto the turning-ON period $T_d'$ of the discharging transistor 207 of FIG. 21, an ON-ON current may flow therethrough during a period ΔT'.

Figure 32:
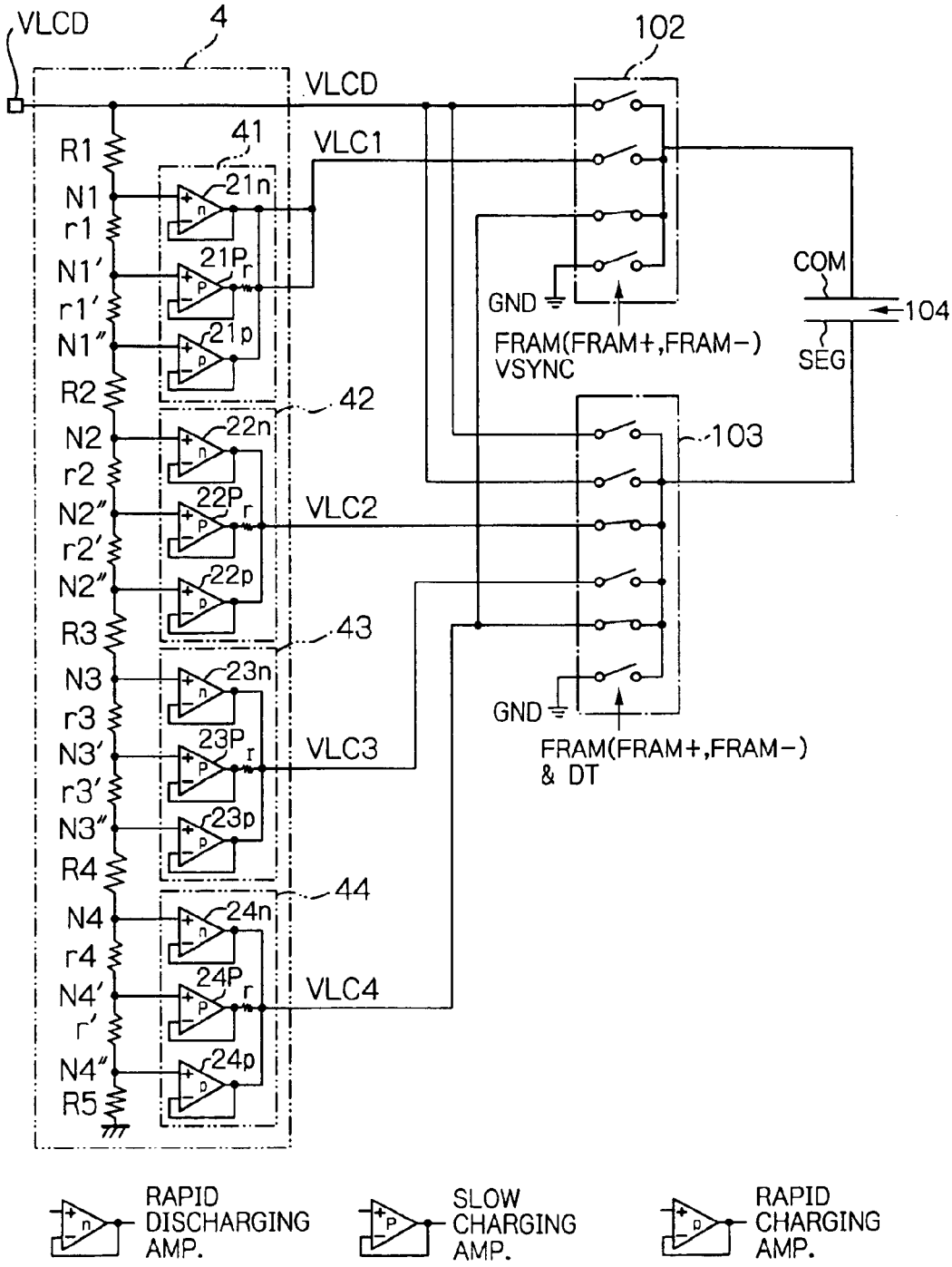
FIG. 32 is a circuit diagram illustrating a third embodiment of the LCD driving apparatus according to the present invention.

In FIG. 32, which illustrates a fourth embodiment of the LCD driving apparatus according to the present invention, the gradation voltage generating circuit 2 of FIG. 20 is replaced by a gradation voltage generating circuit 4.

In the gradation voltage generating circuit 4, resistors r1', r2', r3' and r4' for other offset voltages are inserted in series with the resistors R1, R2, R3 and R4 of FIG. 20. Also, the push-pull type amplifiers 21, 22, 23 and 24 of FIG. 20 are replaced by push-pull type amplifiers 41, 42, 43 and 44, respectively. Each of the push-pull type amplifiers 41, 42, 43 and 44 further includes a rapid charging amplifier such as 21*p* in addition to the rapid discharging amplifier such as 21*n* and the slow charging amplifier 21*p* as illustrated in FIG. 33.

Figure 33:
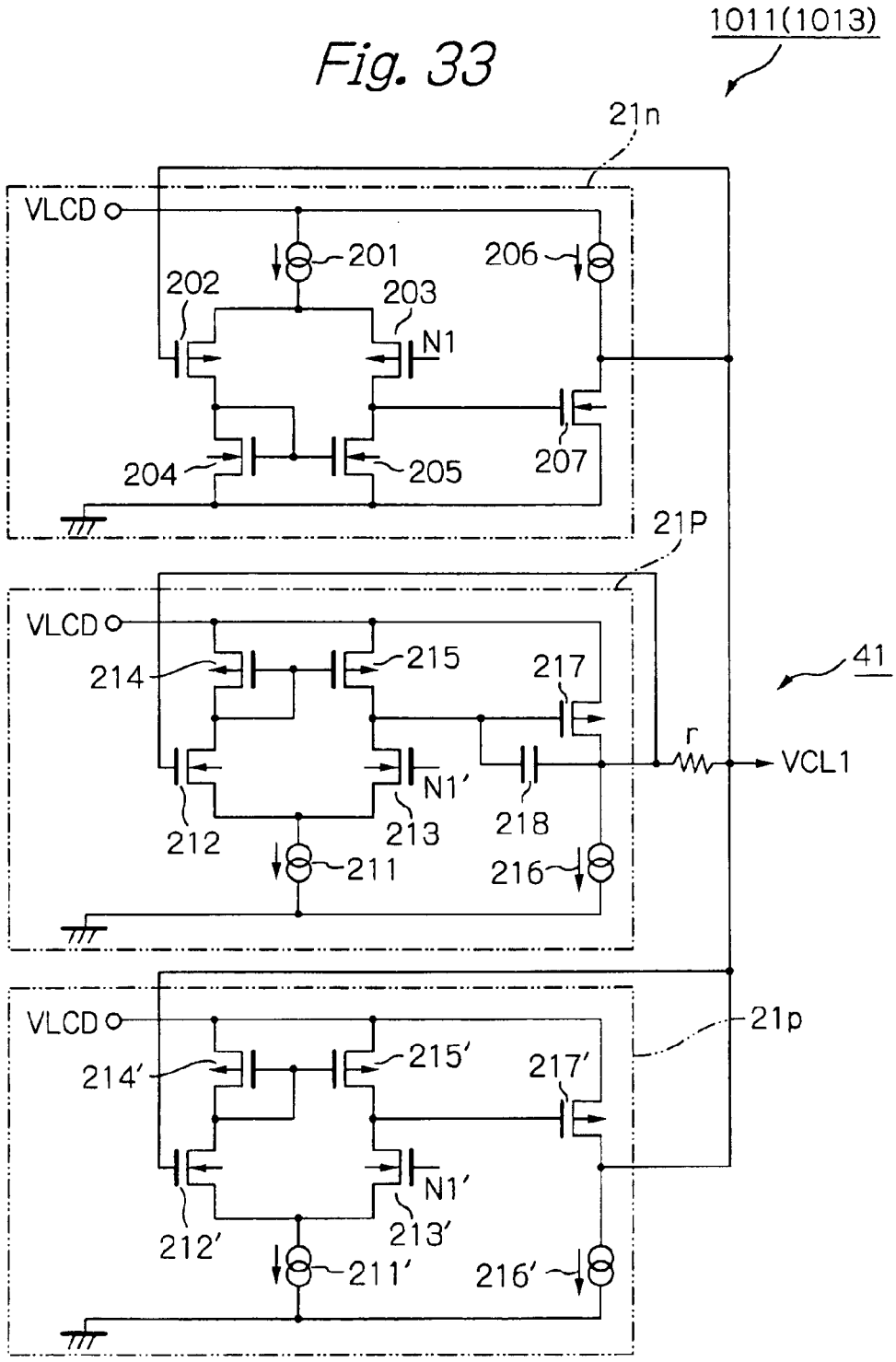
FIG. 33 is a circuit diagram of the push-pull type amplifier of FIG. 32.

In FIG. 33, the rapid charging amplifier such as 21*p* has the same configuration as the slow discharging amplifier 21N except that the capacitor 218 is not provided.

Figure 34:
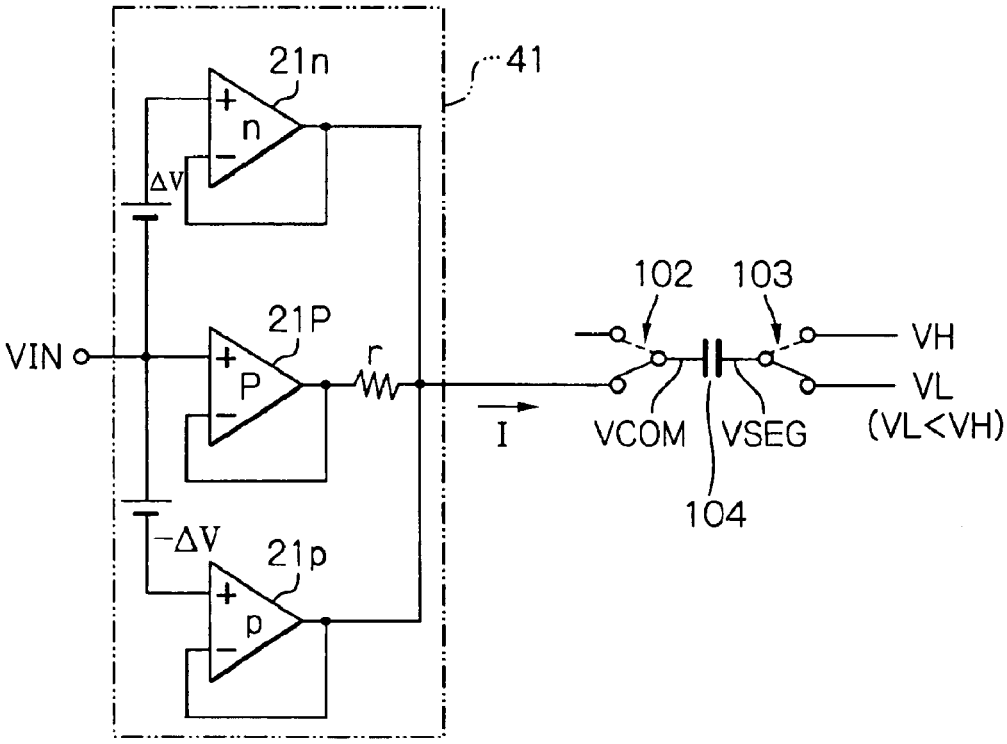
FIG. 34 is a circuit diagram including the push-pull type amplifier of FIG. 33.
Figure 35:
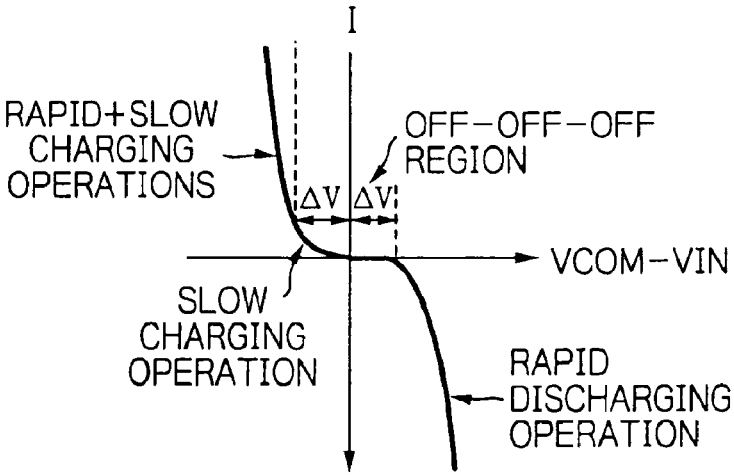
FIG. 35 is a graph showing the voltage-to-current characteristics of the push-pull type amplifier of FIG. 34.

The operation of the push-pull type amplifier of FIG. 33 will be explained next with reference to FIGS. 34 and 35. In FIG. 34, the push-pull type amplifier of FIG. 27 is connected by the decoder 102 to the liquid crystal panel 104 so that the voltage VCOM at the common electrode COM is VCOM=VIN while the voltage VSEG at the segment electrode SEG receives a voltage VL or VH via the decoder 103. In this case, the voltage (VCOM−VIN)-to-current I characteristics of the push-pull type amplifier of FIG. 34 are shown in FIG. 35. In FIG. 35, if VCOM≦VIN, the current I is very large due to the turning-ON of the transistor 207 of FIG. 33. On the other hand, if −ΔV<VCOM−VIN≦0, the current I is relatively large due to the turning-ON of the transistor 217 of FIG. 33. Further, if VCOM≦VIN−ΔV, the current I is very large due to the turning-ON of the transistors 217 and 217' of FIG. 33.

Note that the rapid amplifiers 21*p* and 21*n* may easily oscillate; in this case, however, since the rapid amplifiers 21*p* and 21*n* connected to the slow charging amplifier 21P which may hardly oscillate, the rapid amplifiers 21*p* and 21*n* hardly oscillate.

Next, the transient characteristics of the voltage VCOM of FIG. 34 are explained with reference to FIG. 36.

First, at time t1 , when the voltage VSEG is increased by the decoder 103 from VL to VH, the voltage VCOM is also increased by the capacitive coupling. In this case, the rapid discharging amplifier 21*n* is operated, i.e., the transistor 207 is turned ON to increase the backward current I, so that the voltage VCOM very rapidly recovers its original level VIN with a time τ0. In this case, an undershoot as indicated X0 is generated.

Next, at time t2 , when the voltage VSEG is decreased by the decoder 103 from VH to VL, the voltage VCOM is also decreased by the capacitive coupling. In this case, the rapid charging amplifier 21*p* and the slow charging amplifier 21*p* are operated, i.e., the transistors 217 and 217' are turned ON to increase the forward current I, so that the voltage VCOM very rapidly recovers its original level VIN with a time τ0'. In this case, a large overshoot may be generated; however, no substantial overshoot as indicated by X0' is generated, because afterward, the operation of the rapid charging amplifier 21*p* is stopped, i.e., only the slow changing amplifier 21P is operated.

Figure 36:
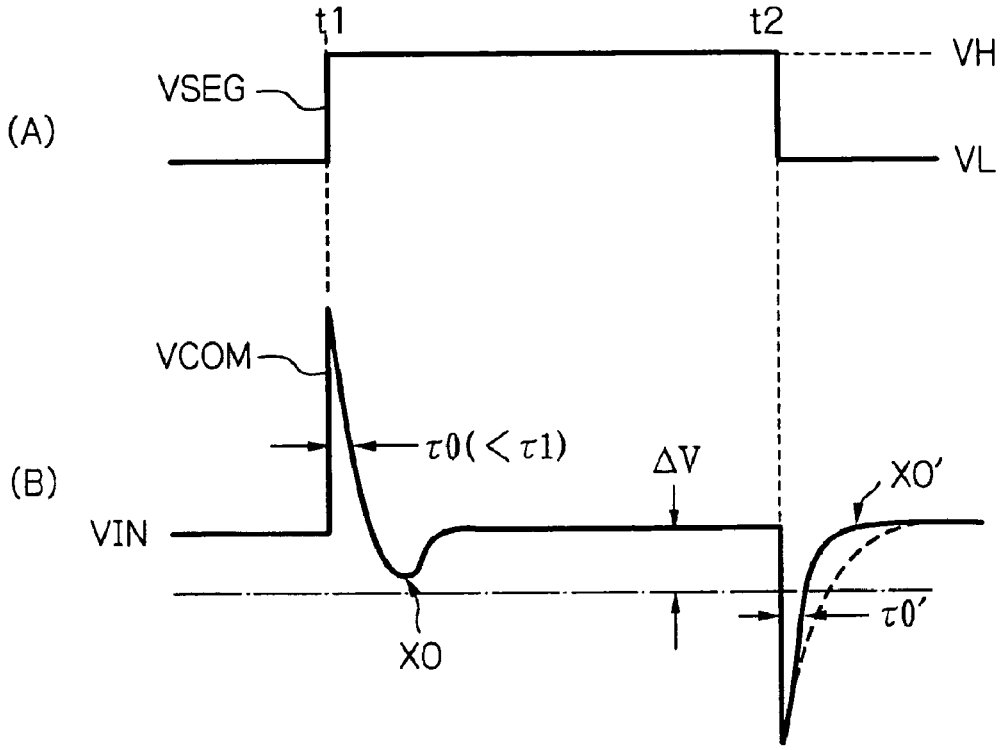
FIG. 36 is a timing diagram for explaining the operation of the push-pull type amplifier of FIG. 34.

Thus, in the LCD driving apparatus of FIG. 32, the discharging amplifier and the charging amplifiers forming one push-pull type amplifier are substantially of a rapid type, even if the offset voltage ΔV is large, the transient response as shown in FIG. 36 is rapid which would invite no flicker.

Figure 37:
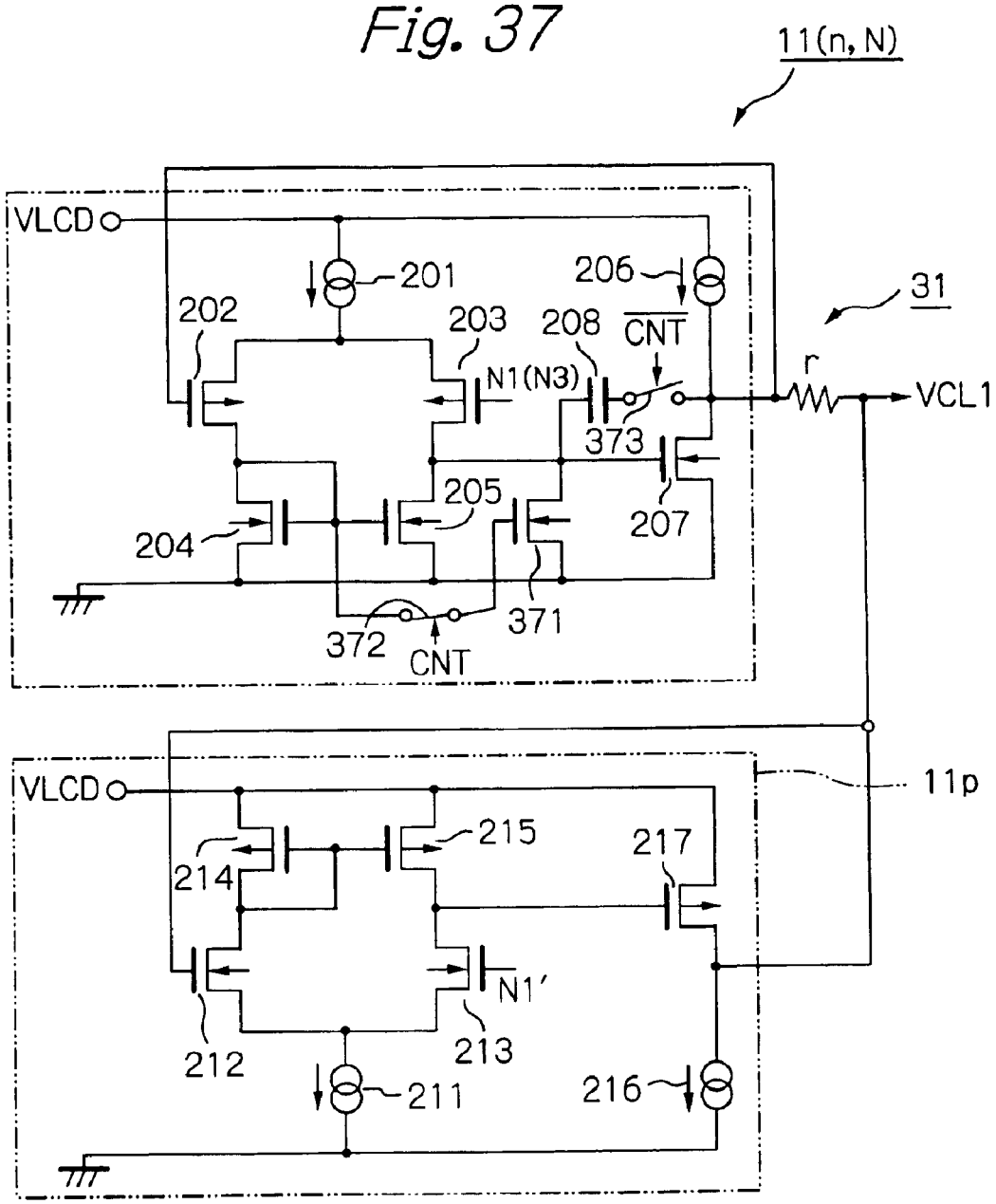
FIG. 37 is a circuit diagram illustrating a modification of the push-pull amplifier of FIG. 27.

In FIG. 37, which illustrates a modification of the push-pull amplifier of FIG. 27, the rapid discharging amplifier 11*n* and the slow discharging amplifier 11N of FIG. 27 are combined into one discharging amplifier 11(n, N). That is, three operational amplifiers are provided in FIG. 27, while two operational amplifiers are provided in FIG. 37. As a result, the push-pull amplifier of FIG. 37 is smaller in size than that of FIG. 27.

In FIG. 37, an N-channel MOS transistor 371 and switches 372 and 373 are added to the slow discharging amplifier 11N of FIG. 27, thus realizing the discharging amplifier 11(n, N). When CNT="0"(low), the switches 372 and 373 are turned ON and OFF, respectively, so that the transistor 371 is turned OFF and the capacitor 208 is active, and thus, the discharging amplifier 11(n, N) serves as the rapid discharging amplifier 11*n* of FIG. 27. On the other hand, when CNT="1"(low), the switches 372 and 373 are turned OFF and ON, respectively, so that the transistor 371 is turned ON and the capacitor 208 is inactive, and thus, the discharging amplifier 11(n, N) serves as the slow discharging amplifier 11N of FIG. 27. In this case, the turning-ON transistor 371 serves as an offset voltage generator, and therefore, the resistors r1', r2', r3' and r4' of FIG. 26 are unnecessary.

Figure 38:
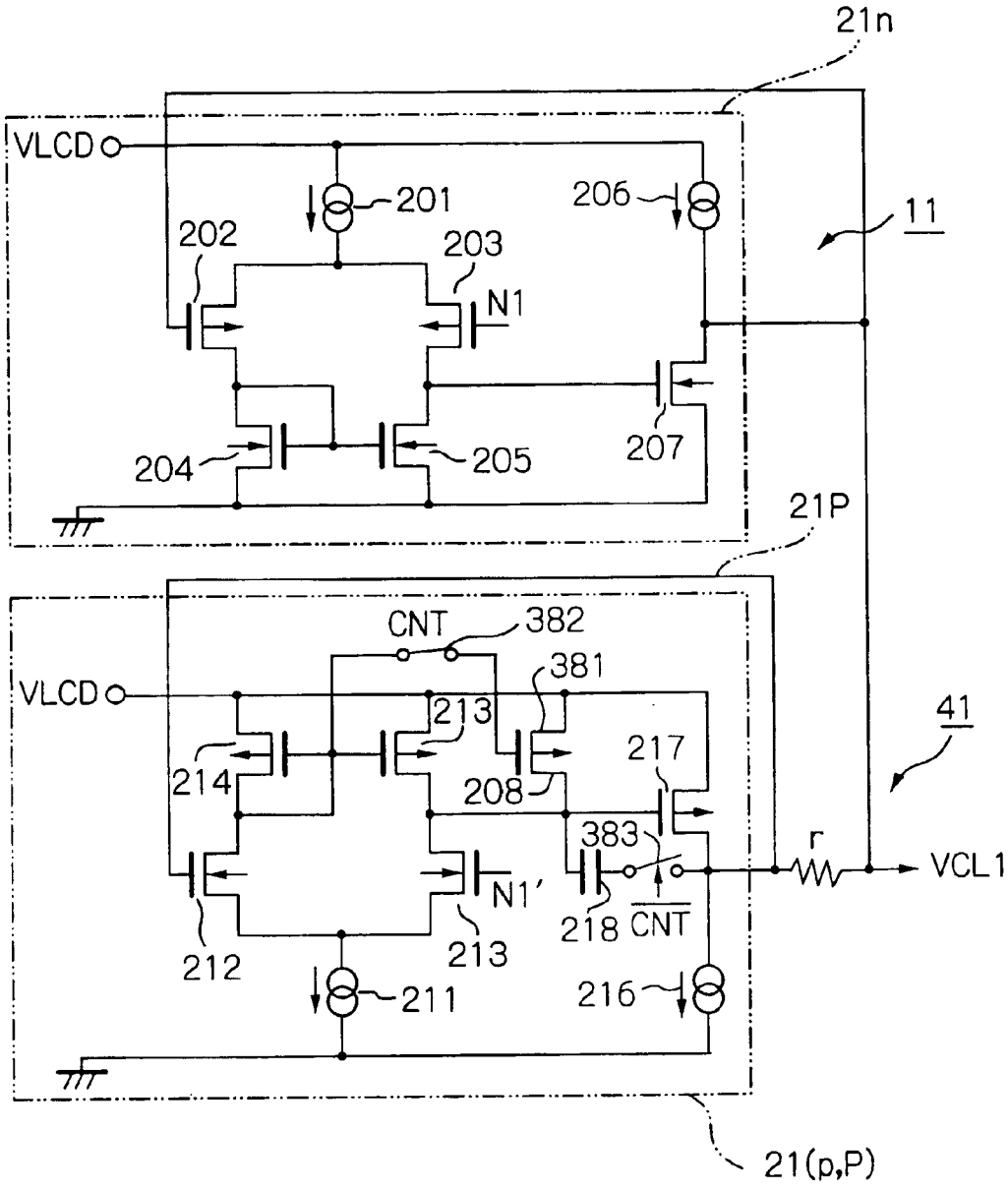
FIG. 38 is a circuit diagram illustrating a modification of the push-pull amplifier of FIG. 33.

In FIG. 38, which illustrates a modification of the push-pull amplifier of FIG. 33, the rapid charging amplifier 21*p* and the slow charging amplifier 21P of FIG. 33 are combined into one charging amplifier 21(p, P). That is, three operational amplifiers are provided in FIG. 33, while two operational amplifiers are provided in FIG. 38. As a result, the push-pull amplifier of FIG. 38 is smaller in size than that of FIG. 33.

In FIG. 38, a P-channel MOS transistor 381 and switches 382 and 383 are added to the slow charging amplifier 21P of FIG. 33, thus realizing the charging amplifier 21(p, P). When CNT="0"(low), the switches 382 and 383 are turned ON and OFF, respectively, so that the transistor 381 is turned OFF and the capacitor 218 is active, and thus, the charging amplifier 21(p, P) serves as the rapid charging amplifier 21*p* of FIG. 33. On the other hand, when CNT="1"(low), the switches 382 and 383 are turned OFF and ON, respectively, so that the transistor 381 is turned ON and the capacitor 218 is inactive, and thus, the charging amplifier 21(p, P) serves as the slow charging amplifier 21P of FIG. 33. In this case, the turning-On transistor 381 serves as an offset voltage generator, and therefore, the resistors r1', r2', r3' and r4' of FIG. 32 are unnecessary.

Figure 39:
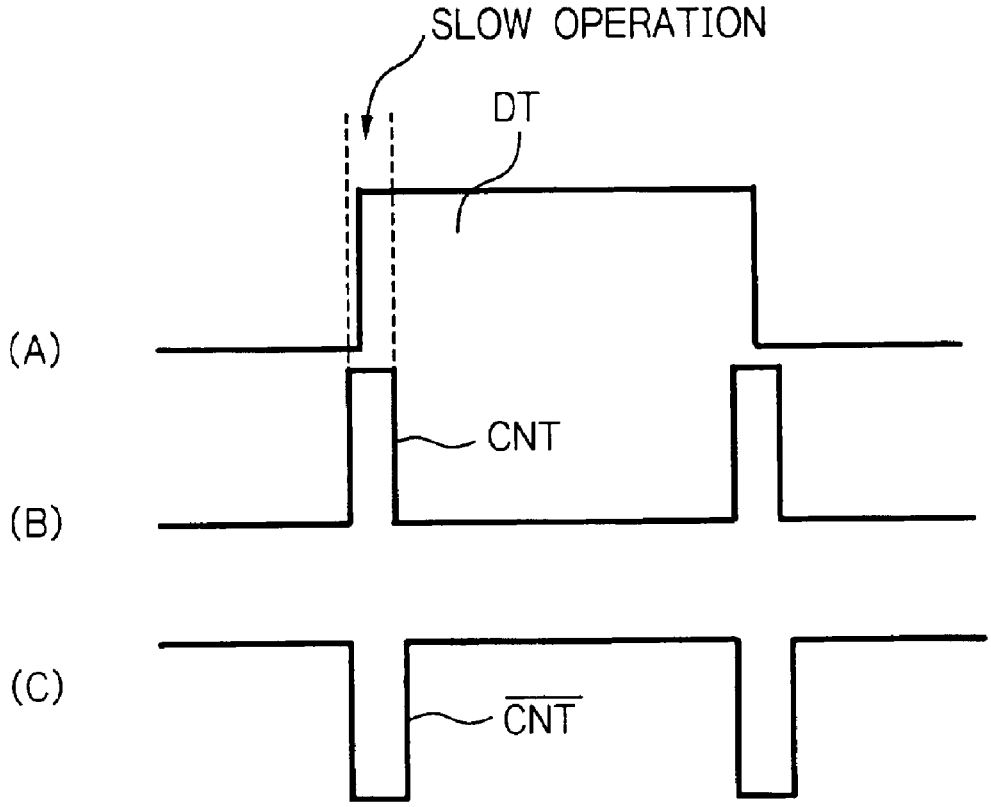
FIG. 39 is a timing diagram showing the control signal and its inverted signal of FIGS. 37 and 38.

The control signal CNT and its inverted signal of FIGS. 37 and 38 are shown in FIG. 39. That is, when the data signal DT is changed, the control signal CNT and its inverted signal are changed for a predetermined time period, so that the discharging amplifier 11(n, N) of FIG. 37 or the charging amplifier 21(p, N) of FIG. 38 carries out a slow discharging or charging operation.

Figure 40:
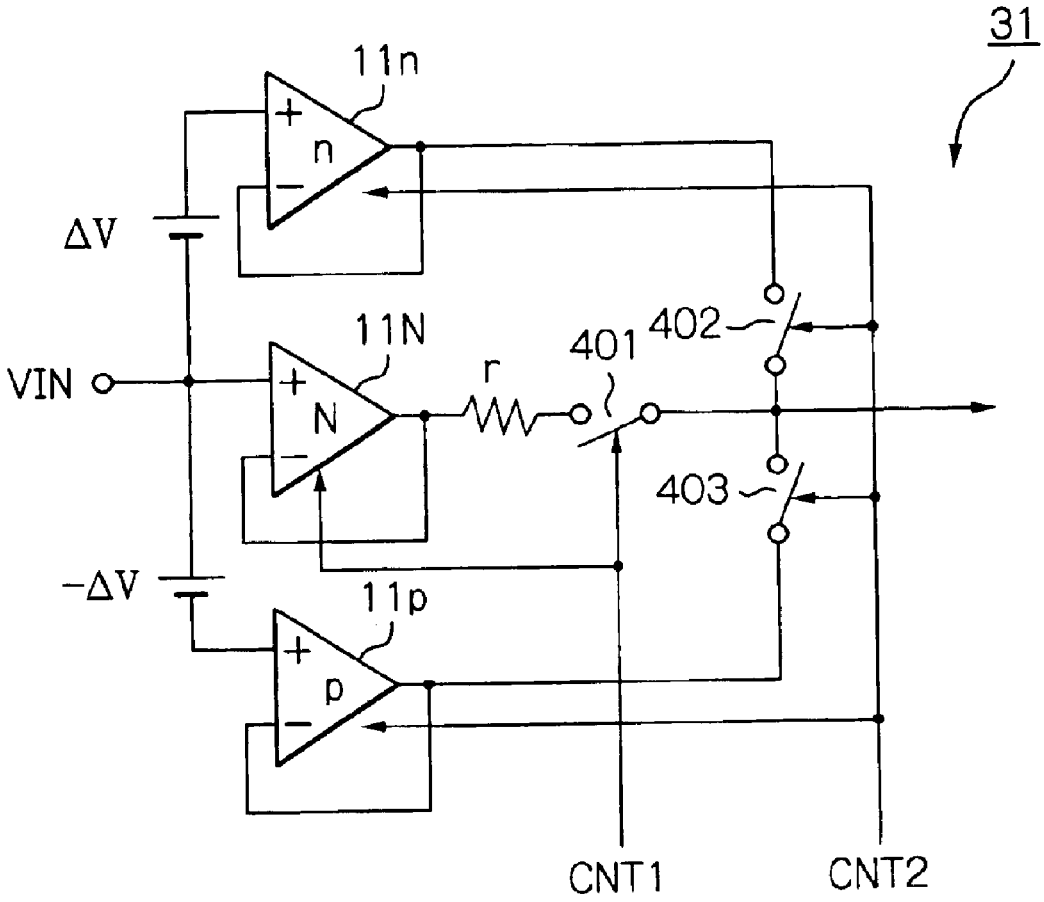
FIG. 40 is a circuit diagram illustrating a modification of the push-pull amplifier of FIG. 28.

In FIG. 40, which illustrates a modification of the push-pull amplifier of FIG. 28, switches 401, 402 and 403 controlled by control signals CNT1 and CNT2 are added to the push-pull amplifier of FIG. 28. That is, the three operational amplifiers are always activated in FIG. 28, while the operational amplifiers are selected and activated in FIG. 40. As a result, the power consumption of the push-pull amplifier of FIG. 40 is smaller than that of the push-pull amplifier of FIG. 28.

In FIG. 40, when the control signal CNT1 and CNT2 are "0"(low) and "1"(high), respectively, the rapid amplifiers 11*n* and 11*p* are activated. On the other hand, when the control signals CNT1 and CNT2 are "1"(high) and "0"(low), respectively, the slow amplifier 11N is activated.

Figure 41:
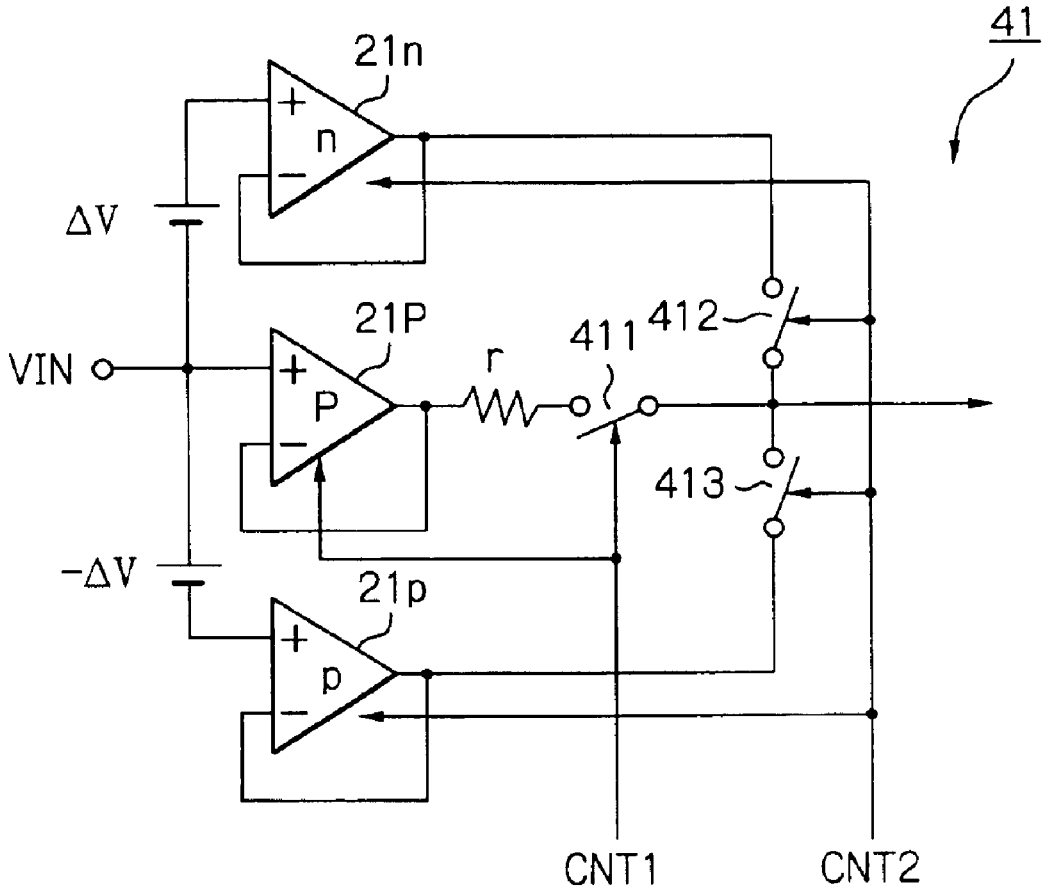
FIG. 41 is a circuit diagram illustrating a modification of the push-pull amplifier of FIG. 34.

In FIG. 41, which illustrates a modification of the push-pull amplifier of FIG. 34, switches 411, 412 and 413 controlled by control signals CNT1 and CNT2 are added to the push-pull amplifier of FIG. 34. That is, the three operational amplifiers are always activated in FIG. 34, while the operational amplifiers are selected and activated in FIG. 41. As a result, the power consumption of the push-pull amplifier of FIG. 41 is smaller than that of the push-pull amplifier of FIG. 34.

In FIG. 41, when the control signals CNT1 and CNT2 are "0"(low) and "1"(high), respectively, the rapid amplifiers 21*n* and 21*p* are activated. On the other hand, when the control signals CNT1 and CNT2 are "1"(high) and "0"(low), respectively, the slow amplifier 21P is activated.

Figure 42:
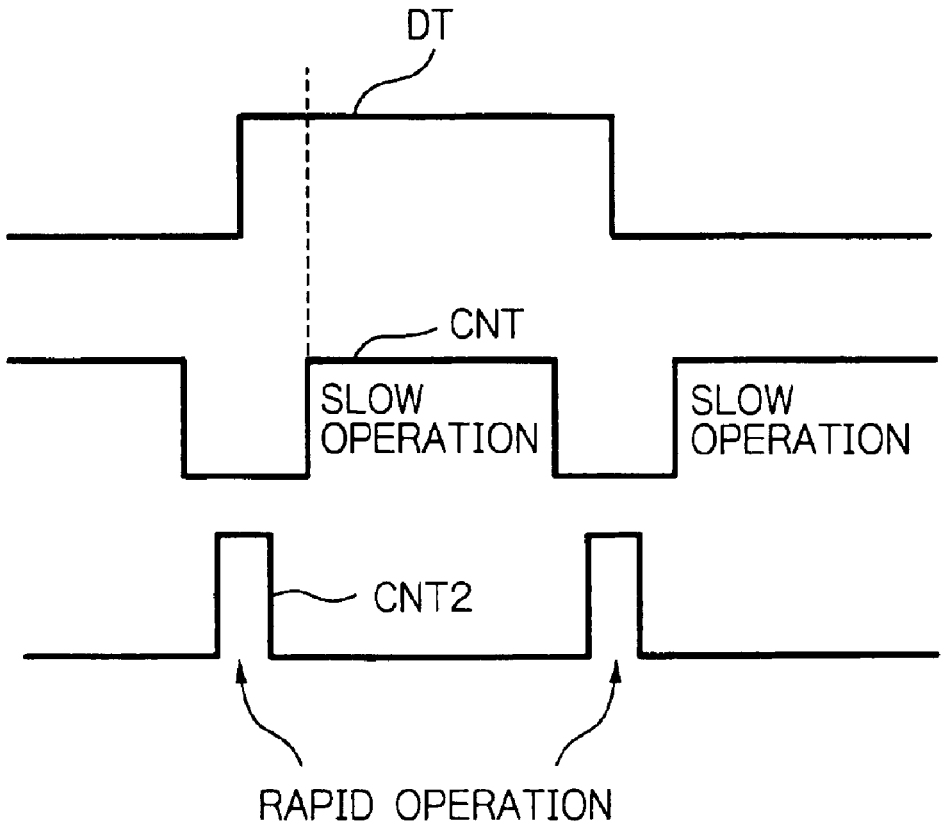
FIG. 42 is a timing diagram showing the control signals of FIGS. 40 and 41.

The control signals CNT1 and CNT2 of FIGS. 40 and 41 are shown in FIG. 42. That is, when the data signal DT is changed, the control signals CNT1 and CNT2 are changed for a predetermined time period, so that the amplifiers 11*p* and 11*n* of FIG. 40 or the rapid amplifiers 21*p* and 21*n* of FIG. 41 carry out a rapid discharging or charging operation.

The present invention can be applied lo a voltage generating apparatus other than a gradation voltage generating circuit in an LCD apparatus.

As explained hereinabove, since at least one rapid amplifier is included in a push-pull type amplifier of a voltage generating apparatus, the transient response characteristics can be rapid. Also, since a slow amplifier is included in the push-pull type amplifier, the rapid amplifier hardly oscillates.

What is claimed is:

1. A voltage generating apparatus comprising:

an input terminal;

an output terminal;

a first offset voltage generating element connected to said input terminal;

a slow discharging amplifier having an input, connected to said input terminal to receive input voltage therefrom, and having an output;

a rapid charging amplifier having an input, connected to said first offset voltage generating element so that the input voltage applied to said slow discharging amplifier is higher than an input voltage applied to said rapid charging amplifier, and having an output; and a current suppressing resistor coupling the output of said slow discharging amplifier to the output of said rapid charging amplifier, wherein the output of one of said slow discharging amplifier and said rapid charging amplifier is connected directly to said output terminal.

2. The voltage generating apparatus as set forth in claim 1, wherein said slow discharging amplifier comprises a first single-end output circuit and an oscillation avoiding capacitor, and said rapid charging amplifier comprises a second single-end output circuit without an oscillation avoiding capacitor.

3. The voltage generating apparatus as set forth in claim 1, further comprising:

a rapid discharging amplifier connected between said input terminal and said output terminal; and a second offset voltage generating element connected between said input terminal and one of said slow discharging amplifier and said rapid discharging amplifier, so that the input voltage applied to said slow discharging amplifier is lower than an input voltage applied to said rapid discharging amplifier.

4. The voltage generating apparatus as set forth in claim 3, wherein said slow discharging amplifier comprises a first single-end output circuit and an oscillation avoiding capacitor, said rapid charging amplifier comprises a second single-end output circuit without an oscillation avoiding capacitor, and said rapid discharging amplifier comprises a third single-end output circuit without an oscillation avoiding capacitor.

5. The voltage generating apparatus as set forth in claim 3, wherein said rapid discharging amplifier and said slow discharging amplifier comprise a single discharging amplifier and switches controlled by control signals, so that said single discharging amplifier serves as said rapid discharging amplifier when said control signals are in a first mode and said single discharging amplifier serves as said slow discharging amplifier when said control signals are in a second mode.

6. The voltage generating apparatus as set forth in claim 5, wherein said second offset voltage generating element is incorporated into said single discharging amplifier.

7. The voltage generating apparatus as set forth in claim 3, further comprising:

a first switch connected between said slow discharging amplifier and said output terminal;

a second switch connected between said rapid discharging amplifier and said output terminal; and a third switch connected between said rapid charging amplifier and said output terminal, wherein said first, second and third switches are controlled so that said slow discharging amplifier, said rapid discharging amplifier and said rapid charging amplifier are selectively activated.

8. A voltage generating apparatus comprising:

an input terminal;

an output terminal;

a first offset voltage generating element connected to said input terminal;

a rapid discharging amplifier having an input, connected to said input terminal to receive input voltage therefrom, and having an output;

a slow charging amplifier having an input, connected to said first offset voltage generating element so that the input voltage applied to said rapid discharging amplifier is higher than an input voltage applied to said slow charging amplifier, and having an output; and a current suppressing resistor coupling the output of said rapid discharging amplifier to the output of said slow charging amplifier, wherein the output of one of said rapid discharging amplifier and said slow charging amplifier is connected directly to said output terminal.

9. The voltage generating apparatus as set forth in claim 8, wherein said rapid discharging amplifier comprises a first single-end output circuit without an oscillation avoiding capacitor, and said slow charging amplifier comprises a second single-end output circuit and an oscillation avoiding capacitor.

10. The voltage generating apparatus as set forth in claim 8, further comprising:

a rapid charging amplifier connected between said input terminal and said output terminal; and a second offset voltage generating element connected between said input terminal and one of said slow charging amplifier and said rapid charging amplifier, so that the input voltage applied to said slow charging amplifier is higher than an input voltage applied to said rapid charging amplifier.

11. The voltage generating apparatus as set forth in claim 10, wherein said rapid discharging amplifier comprises a first single-end output circuit without an oscillation avoiding capacitor, said slow charging amplifier comprises a second single-end output circuit and an oscillation avoiding capacitor, and said rapid charging amplifier comprises a third single-end output circuit without an oscillation avoiding capacitor.

12. The voltage generating apparatus as set forth in claim 10, wherein said rapid charging amplifier and said slow charging amplifier comprise a single charging amplifier and switches controlled by control signals, so that said single charging amplifier serves as said rapid charging amplifier when said control signals are in a first mode and said single charging amplifier serves as said slow charging amplifier when said control signals are in a second mode.

13. The voltage generating apparatus as set forth in claim 12, wherein said second offset voltage generating element is incorporated into said single charging amplifier.

14. The voltage generating apparatus as set forth in claim 10, further comprising:

a first switch connected between said slow charging amplifier and said output terminal;

a second switch connected between said rapid discharging amplifier and said output terminal; and a third switch connected between said rapid charging amplifier and said output terminal;

wherein said first, second and third switches are controlled so that said slow charging amplifier, said rapid discharging amplifier and said rapid charging amplifier are selectively activated.

15. A voltage generating apparatus comprising:

an input terminal;

an output terminal;

a rapid discharging amplifier connected between said input terminal and said output terminal;

a slow discharging amplifier connected between said input terminal and said output terminal;

a rapid charging amplifier connected between said input terminal and said output terminal;

a first offset voltage generating element connected between said input terminal and one of said rapid discharging amplifier and said slow discharging amplifier, so that an input voltage applied to said rapid discharging amplifier is higher than an input voltage applied to said slow discharging amplifier; and a second offset voltage generating element connected between said input terminal and one of said slow discharging amplifier and said rapid charging amplifier, so that the input voltage applied to said slow discharging amplifier is higher than an input voltage applied to said rapid charging amplifier.

16. A voltage generating apparatus comprising:

an input terminal;

an output terminal;

a rapid discharging amplifier connected between said input terminal and said output terminal;

a slow charging amplifier connected between said input terminal and said output terminal;

a rapid charging amplifier connected between said input terminal and said output terminal;

a first offset voltage generating element connected between said input terminal and one of said rapid discharging amplifier and said slow charging amplifier, so that an input voltage applied to said rapid discharging amplifier is higher than an input voltage applied to said slow charging amplifier; and a second offset voltage generating element connected between said input terminal and one of said slow charging amplifier and said rapid charging amplifier, so that the input voltage applied to said slow charging amplifier is higher than an input voltage applied to said rapid charging amplifier.

17. The voltage generating apparatus as set forth in claim 15, wherein said rapid discharging amplifier comprises a first single-end output circuit without an oscillation avoiding capacitor, said slow discharging amplifier comprises a second single-end output circuit and an oscillation avoiding capacitor, and said rapid charging amplifier comprises a third single-end output circuit without an oscillation avoiding capacitor.

18. The voltage generating apparatus as set forth in claim 15, wherein said rapid discharging amplifier and said slow discharging amplifier comprise a single discharging amplifier and switches controlled by control signals, so that said single discharging amplifier serves as said rapid discharging amplifier when said control signals are in a first mode and said single discharging amplifier serves as said slow discharging amplifier when said control signals are in a second mode.

19. The voltage generating apparatus as set forth in claim 18, wherein said second offset voltage generating element is incorporated into said single discharging amplifier.

20. The voltage generating apparatus as set forth in claim 15, further comprising:

a first switch connected between said rapid discharging amplifier and said output terminal;

a second switch connected between said slow discharging amplifier and said output terminal; and a third switch connected between said rapid charging amplifier and said output terminal, wherein said first, second and third switches are controlled so that said slow discharging amplifier, said rapid discharging amplifier and said rapid charging amplifier are selectively activated.

21. The voltage generating apparatus as set forth in claim 16, wherein said rapid discharging amplifier comprises a first single-end output circuit without an oscillation avoiding capacitor, said slow charging amplifier comprises a second single-end output circuit and an oscillation avoiding capacitor, and said rapid charging amplifier comprises a third single-end output circuit without an oscillation avoiding capacitor.

22. The voltage generating apparatus as set forth in claim 16, wherein said rapid charging amplifier and said slow charging amplifier comprise a single charging amplifier and switches controlled by control signals, so that said single charging amplifier serves as said rapid charging amplifier when said control signals are in a first mode and said single charging amplifier serves as said slow charging amplifier when said control signals are in a second mode.

23. The voltage generating apparatus as set forth in claim 22, wherein said second offset voltage generating element is incorporated into said single charging amplifier.

24. The voltage generating apparatus as set forth in claim 16, further comprising:

a first switch connected between said rapid discharging amplifier and said output terminal;

a second switch connected between said slow charging amplifier and said output terminal; and a third switch connected between said rapid charging amplifier and said output terminal;

wherein said first, second and third switches are controlled so that said slow charging amplifier, said rapid discharging amplifier and said rapid charging amplifier are selectively activated.

* * * * *